US006009289A

United States Patent [19]

Sekine et al.

[11] Patent Number: 6,009,289

[45] **Date of Patent: *Dec. 28, 1999**

[54] PROCESS CARTRIDGE, DEVELOPER CONTAINER, WASTE DEVELOPER CONTAINER, METHOD FOR ASSEMBLING PROCESS CARTRIDGE, METHOD FOR REPLENISHING DEVELOPER IN PROCESS CARTRIDGE

[75] Inventors: Kazumi Sekine, Shizuoka-ken; Shinichi Sasaki, Fujisawa, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/927,669

[22] Filed: Sep. 10, 1997

[30] Foreign Application Priority Data

Sep. 12, 1996 [JP] Japan ..... 8-242172
Aug. 21, 1997 [JP] Japan ..... 9-255377

[51] Int. Cl.[6] ..... G03G 21/16

[52] U.S. Cl. ..... 399/113; 399/119

[58] Field of Search ..... 399/113, 120, 399/111, 123, 110, 411, 119

[56] References Cited

U.S. PATENT DOCUMENTS 4,839,691 6/1989 Tagawa et al. .
4,924,267 5/1990 Yoshikawa et al. .
4,952,989 8/1990 Kawano et al. .
5,049,940 9/1991 Yamaguchi et al. .
5,153,640 10/1992 Okabe .
5,331,372 7/1994 Tsuda et al. .
5,369,479 11/1994 Tsuyuki .
5,485,249 1/1996 Higeta et al. .
5,500,714 3/1996 Yashiro et al. .
5,537,187 7/1996 Sekine .
5,543,898 8/1996 Shishido et al. .
5,552,857 9/1996 Ishikawa .
5,623,328 4/1997 Tsuda et al. .
5,689,774 11/1997 Shishido et al. .
5,708,925 1/1998 Kobayashi et al. ..... 399/120

FOREIGN PATENT DOCUMENTS

0501497A2 9/1992 European Pat. Off. .
0615175A2 9/1994 European Pat. Off. .
0708387A2 4/1996 European Pat. Off. .
02257146 10/1990 Japan .

*Primary Examiner*—Richard Moses
*Attorney, Agent, or Firm*—Fitzpatrick, Cella, Harper & Scinto

[57] ABSTRACT

A process cartridge detachably mountable to a main body of an electrophotographic image forming apparatus, includes a first frame for supporting an electrophotographic photosensitive drum and a developer bearing member for developing a latent image formed on the electrophotographic photosensitive drum with a developer, and a second frame having a developer containing portion containing the developer for developing the latent image formed on the electrophotographic photosensitive drum and detachably mountable to the first frame. The mounting and dismounting direction of the second frame with respect to the first frame is transverse to an axial direction of the electrophotographic photosensitive drum.

42 Claims, 17 Drawing Sheets

PROCESS CARTRIDGE, DEVELOPER CONTAINER, WASTE DEVELOPER CONTAINER, METHOD FOR ASSEMBLING PROCESS CARTRIDGE, METHOD FOR REPLENISHING DEVELOPER IN PROCESS CARTRIDGE

BACKGROUND OF THE INVENTION

1. Field of the Invention

The present invention relates to a process cartridge removably mountable to a main body of an electrophotographic image forming apparatus, a developer container, a waste developer container, a method for assembling such a process cartridge, a method for replenishing developer in such a process cartridge, a support frame used in such a process cartridge and a method for assembling such a support frame.

An electrophotographic image forming apparatus is an apparatus in which an image is formed on a recording medium by using an electrophotographic image forming system. Such an electrophotographic image forming apparatus may be an electrophotographic copying machine, an electrophotographic printer (laser beam printer, LED printer or the like), an electrophotographic facsimile, an electrophotographic word processor or the like.

The process cartridge incorporates therein a charge means, a developing means or a cleaning means and an electrophotographic photosensitive drum as a cartridge unit which can removably be mounted to the main body. The process cartridge may incorporate therein at least one of a charge means, a developing means and a cleaning means, and an electrophotographic photosensitive drum as a cartridge unit which can removably be mounted to the main body, or may incorporate therein at least one of a developing means, and an electrophotographic photosensitive drum as a cartridge unit which can removably be mounted to the main body.

2. Related Background Art

In conventional electrophotographic image forming apparatuses using an electrophotographic image forming process, a process cartridge, in which an electrophotographic photosensitive member and process means acting on the electrophotographic photosensitive member are integrally incorporated into a cartridge unit which can removably be mounted to the main body of image forming apparatus has been utilized. By using such a process cartridge, the maintenance of the apparatus can be performed by the user himself without any expert, and thus the operability of the apparats is considerably improved. Thus, process cartridges have become widely used in electrophotographic image forming apparatuses.

In such process cartridges, there has been proposed a technique in which a toner (developer) container containing new toner can be detachably mounted to a main body of the process cartridge (for example, refer to Japanese Patent Application Laid-Open No. 2-257146).

SUMMARY OF THE INVENTION

An object of the present invention is to provide a process cartridge, a developer container, a waste developer container, a method for assembling such a process cartridge, a method for replenishing developer in such a process cartridge, a support frame used in such a process cartridge, and a method for assembling such a support frame, which enable replenishment of developer.

Another object of the present invention is to provide a process cartridge, a developer container, a waste developer container, a method for assembling such a process cartridge, a method for replenishing developer in such a process cartridge, a support frame used in such a process cartridge and a method for assembling such a support frame, which enable the assembly and disassembly of the cartridge.

A further object of the present invention is to provide a process cartridge, a developer container, a waste developer container, a method for assembling such a process cartridge, a method for replenishing developer in such a process cartridge, a support frame used in such a process cartridge, and a method for assembling such a support frame, which prevent the swelling of the developer container.

A still further object of the present invention is to provide a process cartridge, a developer container, a waste developer container, a method for assembling such a process cartridge, a method for replenishing developer in such a process cartridge, a support frame used in such a process cartridge, and a method for assembling such a support frame, which enable the mounting and dismounting of the frame.

A further object of the present invention is to provide a process cartridge, a developer container, a waste developer container, a method for assembling such a process cartridge, a method for replenishing developer in such a process cartridge, a support frame used in such a process cartridge, and a method for assembling such a support frame, in which the frame can be re-used.

Another object of the present invention is to provide a process cartridge including a first frame for supporting an electrophotographic photosensitive drum and a developer bearing member for developing a latent image formed on the electrophotographic photosensitive drum with developer and a second frame having a developer container portion containing the developer for developing the latent image formed on the electrophotographic photosensitive drum and detachably mountable to the first frame, a developer container associated with such a process cartridge, a waste developer container associated with such a process cartridge, a method for assembling such a process cartridge, a method for replenishing developer in such a process cartridge, a support frame used in such a process cartridge, and a method for assembling such a support frame.

DETAILED DESCRIPTION OF THE PREFERRED EMBODIMENTS

The present invention will now be explained in connection with embodiments thereof with reference to the accompanying drawings.

In the following explanation, a developer container, a process cartridge having such a developer container, and an electrophotographic image forming apparatus to which such a process cartridge can detachably be mounted, will be described as an example.

Figure 1:
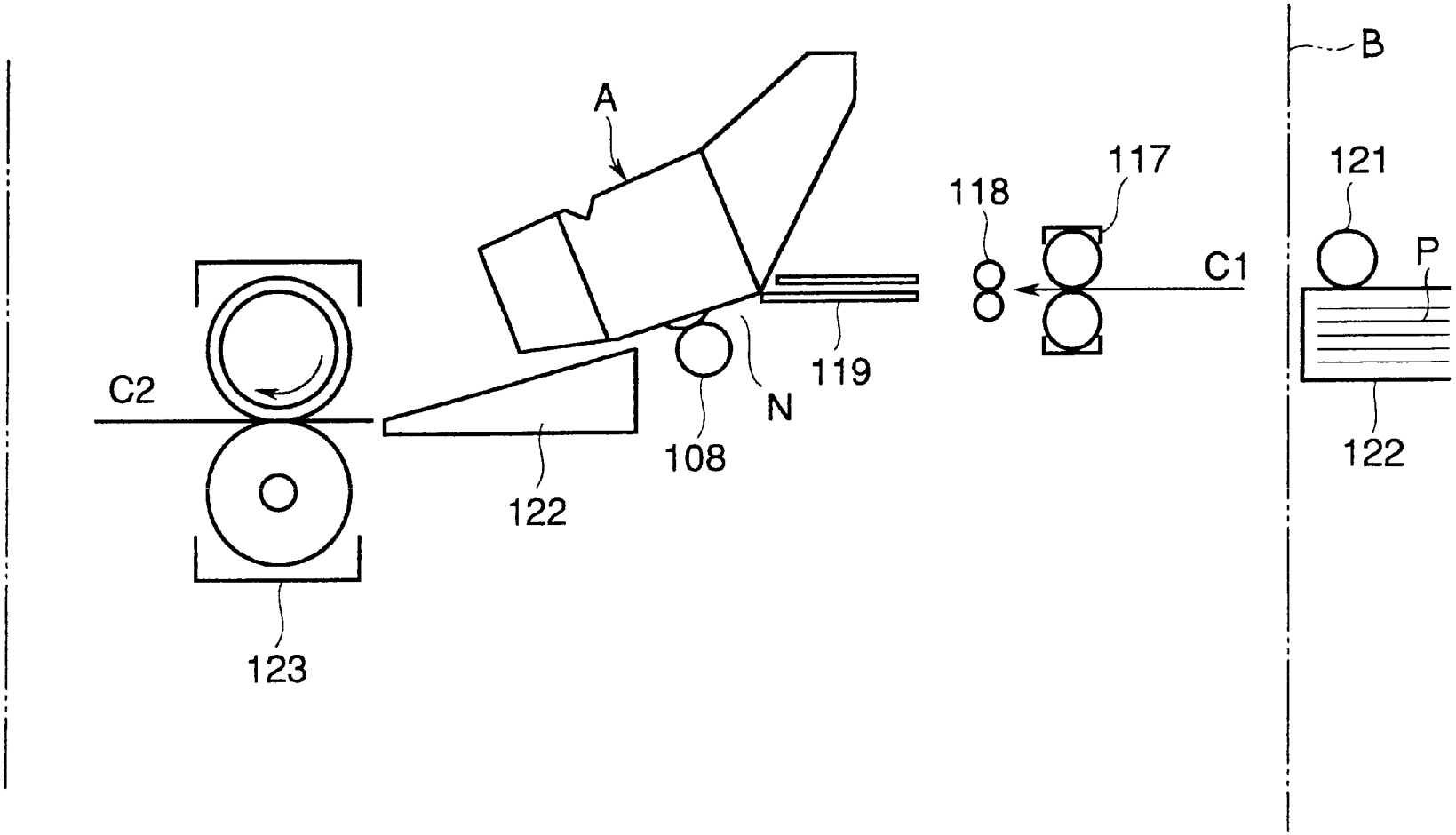
FIG. 1 is a schematic view showing an electrophotographic image forming apparatus having a process cartridge according to a first embodiment of the present invention.

FIG. 1 schematically illustrates a part of an electrophotographic image forming apparatus having a process cartridge according to a first embodiment, a process cartridge A and a main body B (of an electrophotographic image forming apparatus). Transfer materials (recording media) P are stacked in a sheet cassette 122 and are supplied one by one by a sheet supply roller 121 in a direction shown by the arrow C1. The supplied transfer material P is conveyed to a transfer nip N between a transfer roller 108 and a photosensitive drum provided in the process cartridge A (described later) through a pair of skew-feed rollers 117, a pair of regist rollers 118 and a transfer guide 119. The pair of skew-feed rollers 117, the pair of regist rollers 118 and the transfer guide 119 constitute a conveying device.

After a toner image is transferred onto the transfer material P introduced into the transfer nip N by the transfer roller 108, the transfer material is sent, through a convey guide 122, to a fixing device 123, to fix the toner image to the transfer material. Thereafter, the transfer material P is conveyed in a direction shown by the arrow C2 and then is discharged out of the main body B.

Figure 2:
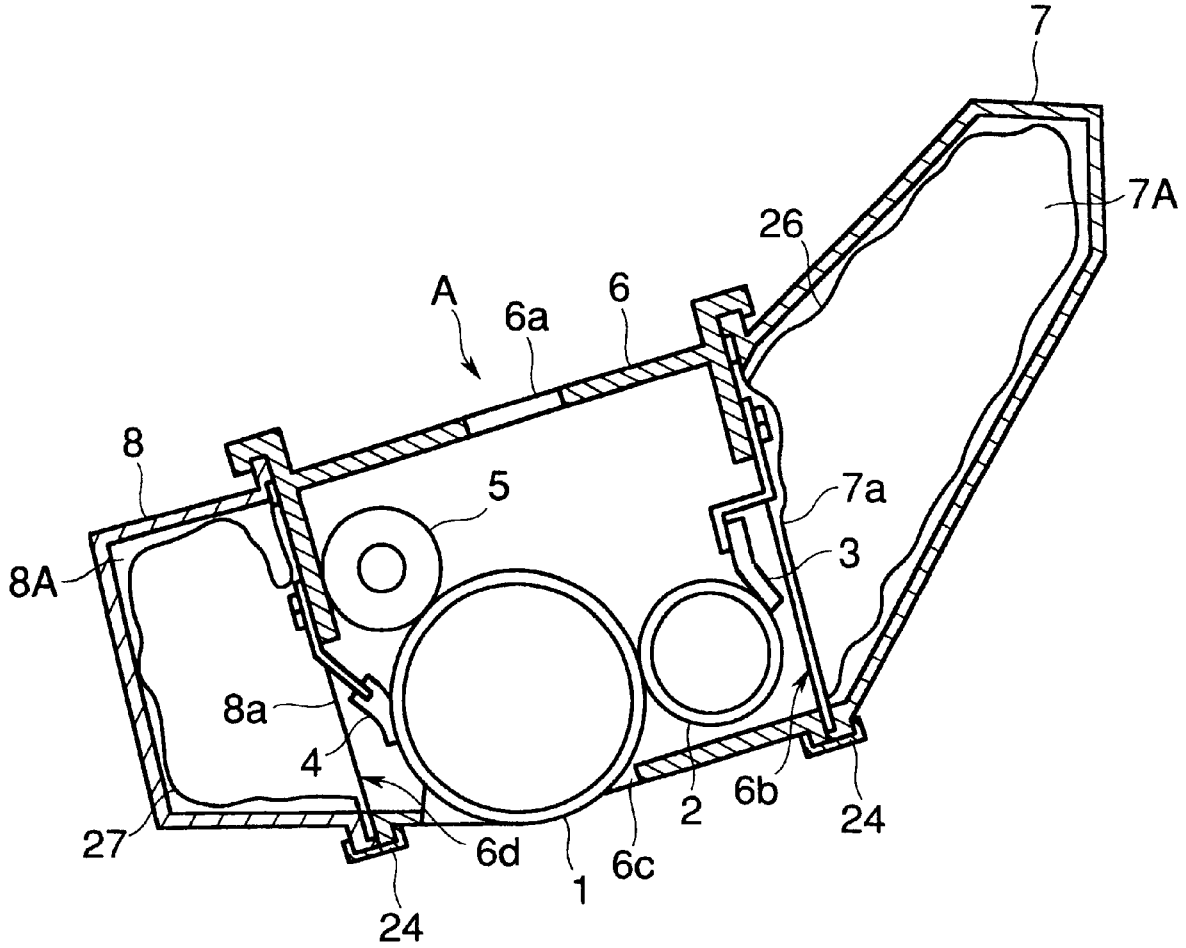
FIG. 2 is a sectional view of the process cartridge according to the first embodiment.

As shown in FIG. 2, the process cartridge A includes a photosensitive drum (electrophotographic photosensitive drum) 1, and, process means comprised of a developing sleeve (developer bearing member) 2 for developing a latent image formed on the photosensitive drum 1 with developer (toner), a layer thickness regulating blade (layer thickness regulating member) 3 for regulating a thickness of a layer of developer formed on the developing sleeve 2, a cleaning blade (cleaning means) 4 for removing residual developer remaining on the photosensitive drum 1 after the transferring, and a charge roller (charge means) 5 for charging a surface of the photosensitive drum 1. Incidentally, a magnet (not shown) is disposed within the developing sleeve 2.

In FIG. 2, the process cartridge comprises a substantially box-shaped first frame 6 for housing the process means, a second frame 7 having a developer containing portion 7A for containing the developer for developing the latent image formed on the photosensitive drum 1, and a third frame 8 having a waste developer containing portion 8A for containing waste developer removed from the photosensitive drum 1 by the cleaning blade 4.

As will be described later, the second frame 7 and the third frame 8 are removably attached to the first frame 6, and elastic members (connection means) 24 are provided for connecting the second frame 7 and the third frame 8 to the first frame 6. A mounting/dismounting direction of the second frame 7 is perpendicular to an axis of the photosensitive drum 1.

The first frame 6 is provided with a first opening 6*a* through which laser light (image signal) from the main body B of the image forming apparatus passes to illuminate onto the photosensitive drum 1 to thereby form the latent image on the drum, a second opening 6*b* through which the developer in the second frame 7 passes toward the developing sleeve 2, a third opening 6*c* through which the image formed on the photosensitive drum 1 is transferred onto the transfer material P, and a fourth opening 6*d* through which the waste developer removed from the photosensitive drum 1 by the cleaning blade 4 passes toward the third frame 8.

The second frame 7 is provided with a developer supply opening 7*a* aligned with the second opening 6*b* when the second frame 7 with the developing sleeve 2 is attached to the first frame 6, and the third frame 8 is provided with a waste developer collecting opening 8*a* aligned with the third opening 6*c* when the third frame 8 is attached to the first frame 6.

In FIG. 2, a developer container 26 having an opening means (described later) and containing non-used developer is replaceably housed in the developer containing portion 7A. The opening means of the developer container 26 is aligned with the developer supply opening 7*a* when the developer container 26 is housed in the second frame 7. The developer container 26 is a bag formed from a permeable sheet preventing passage of the developer but permitting passage of air. The developer container 26 will be fully described later.

In FIG. 2, a waste developer container 27 for containing the waste developer removed from the photosensitive drum 1 is replaceably housed in the waste developer containing portion 8A. The waste developer container 27 will be fully described later.

Figure 3:
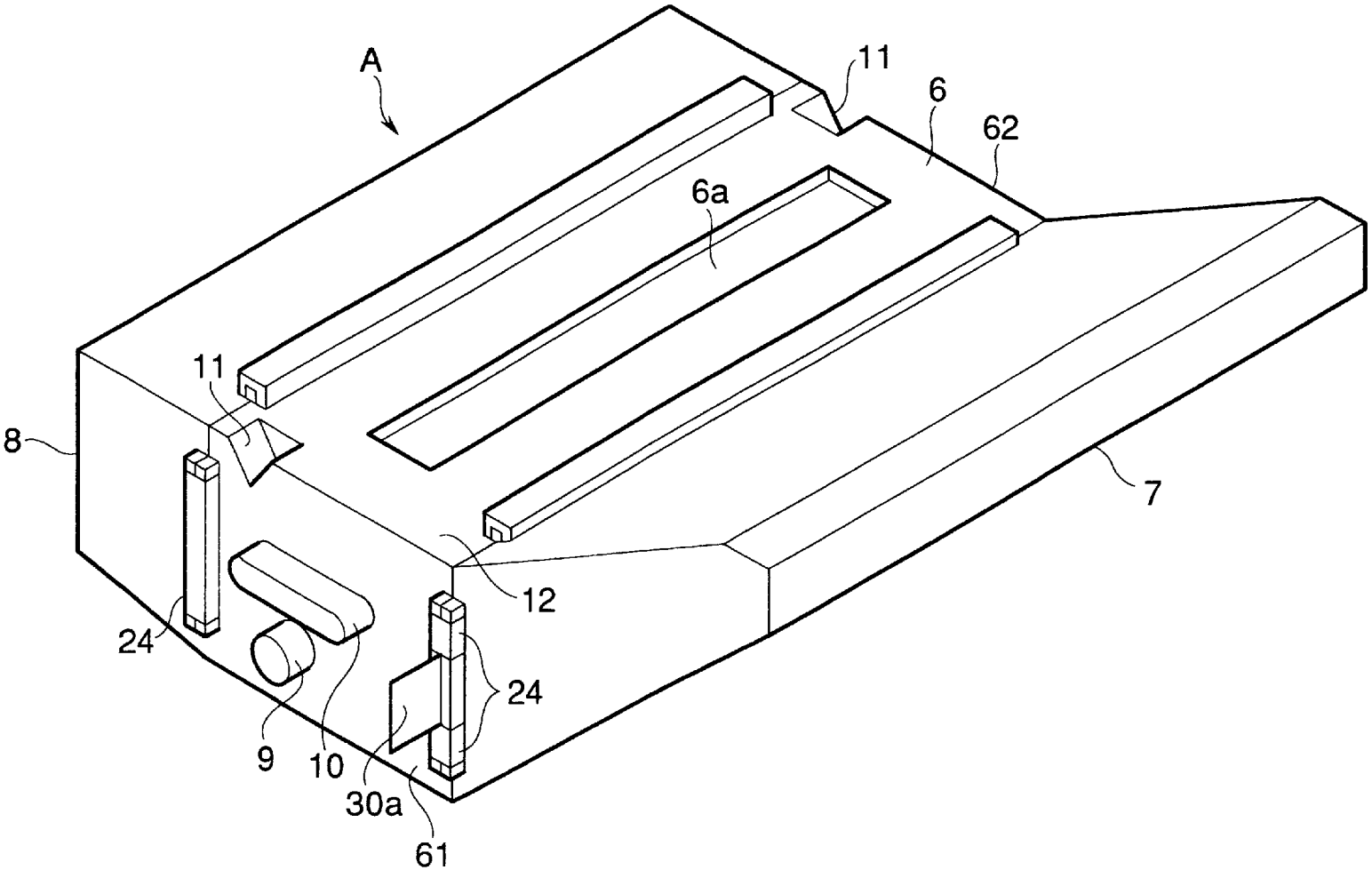
FIG. 3 is a perspective view of the process cartridge looked at from above.

As shown in FIG. 3, first positioning means 9 are formed on both side surfaces 61, 62 of the first frame 6 substantially in alignment with the axis of the photosensitive drum 1. The first positioning means 9 are slid along second guide means (described later) provided on the main body B of the image forming apparatus and to serves to engage the process cartridge A by positioning means of the main body B.

Elongated guide portions 10 protrude from the side surfaces of the first frame immediately above the first positioning means 9. The guide portions 10 serve to guide the mounting and dismounting of the process cartridge A and slide along first guide means (described later) provided on the main body B of the image forming apparatus when the process cartridge A is mounted to and dismounted from the main body B.

Second positioning means 11 are provided on both lateral edge portions of an upper surface of the first frame 6. The second positioning means 11 abut against rotation regulating portions (described later) provided on the main body B of the image forming apparatus to regulate or prevent the process cartridge A from rotating around the first positioning means 9. The first positioning means 9, the second guide means, guide portions 10 and first guide means constitute a mounting means for detachably mounting the process cartridge A to the main body B of the image forming apparatus.

The upper surface of the first frame 6 serves as a pressed portion 12 against which an urging means (described later) provided on the main body B of the image forming apparatus abuts when the process cartridge A is mounted to and dismounted from the main body B. The first opening 6*a* is formed in the upper surface. The reference numeral 30*a* denotes a portion of a tear tape for opening or unsealing the developing container 26, which will be fully described later.

Figure 4:
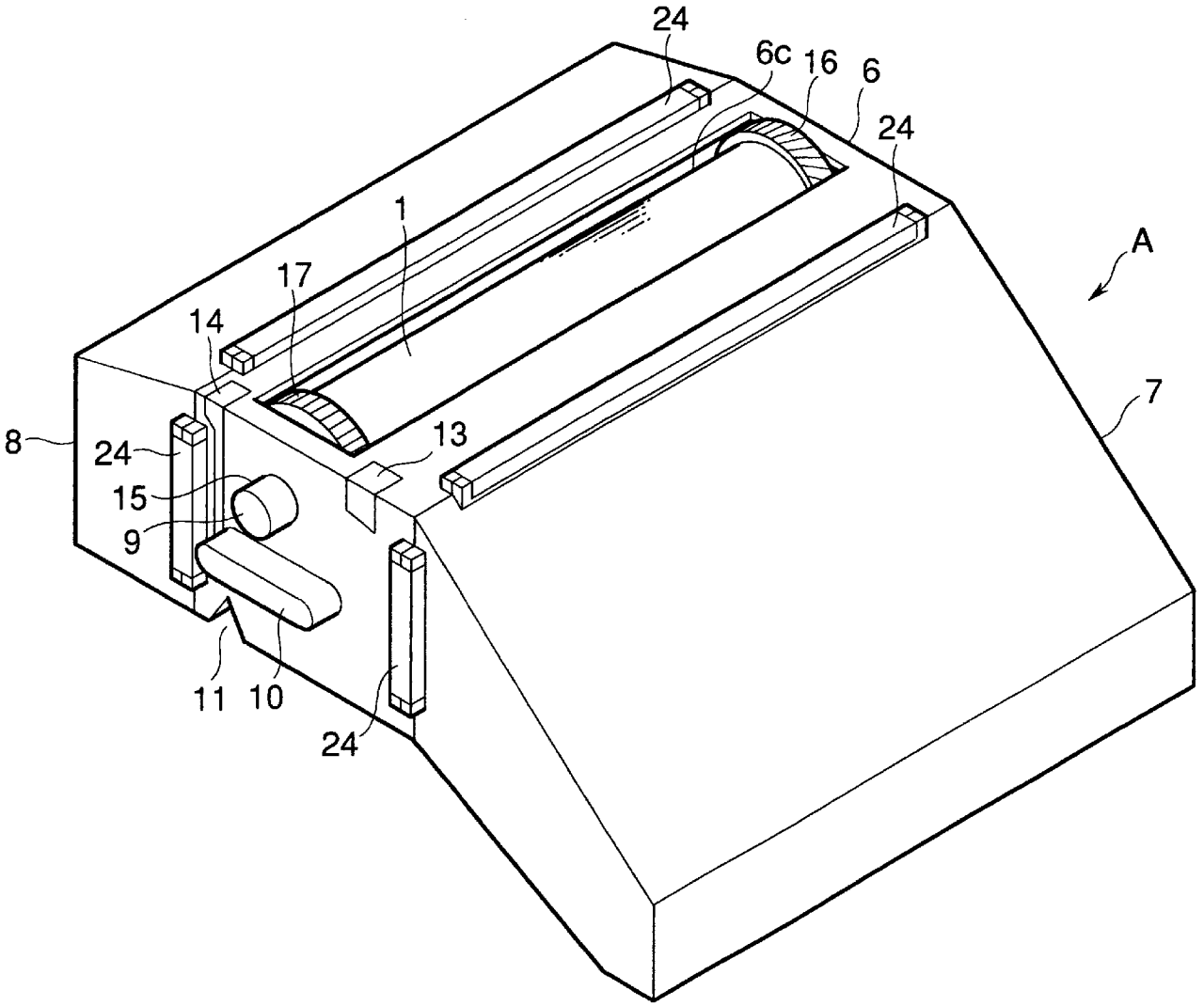
FIG. 4 is a perspective view of the process cartridge looked at from below.

On the other hand, as shown in FIG. 4, a first electrical contact 13 (developing contact), a second electrical contact 14 (charge contact) and a third electrical contact 15 (drum grounding contact) are provided on a bottom surface of the first frame 6 in which the third opening 6*c* is formed.

The first electrical contact 13 is formed from a conductive member to be contacted with a first contact (described later) provided on the main body B of the image forming apparatus to receive a developing bias (to be supplied to the developing sleeve 2) from the main body B when the process cartridge A is mounted to the main body B. The second electrical contact 14 is formed from a conductive member to be contacted with a second contact (described later) provided on the main body B of the image forming apparatus to receive a charging bias (to be supplied to the charge roller 5) from the main body B when the process cartridge A is mounted to the main body B.

The third electrical contact 15 is formed from a conductive member to ground the photosensitive drum 1. The third electrical contact is provided on at least one of the pair of first positioning means (members) 9. The first positioning means 9 bearing the third electrical contact 15 is formed from conductive material to permit the grounding of the photosensitive drum 1.

In FIG. 4, a first gear 16 is provided on one end of the photosensitive drum 1, and the photosensitive drum 1 receives a driving force from the main body B through the first gear 16. A second gear 17 is provided on the other end of the photosensitive drum 1, and the rotation of the photosensitive drum 1 is transmitted to the transfer roller 108 (FIG. 1) provided in the main body B through the second gear 17.

Figure 5:
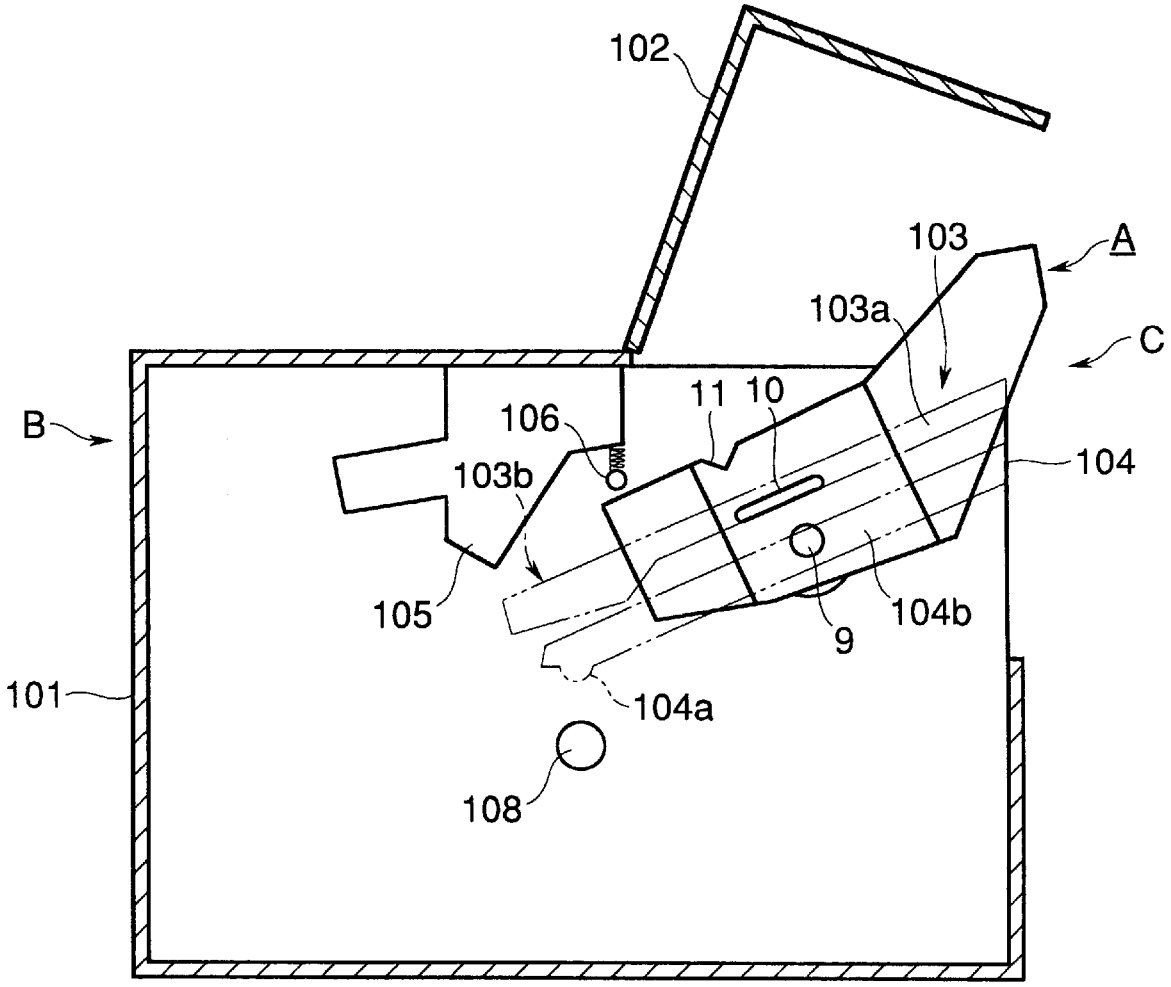
FIG. 5 is an explanatory view showing a condition that the process cartridge is being mounted in the main body.

FIG. 5 is an explanatory view showing a condition that the process cartridge A is mounted to the main body B of the image forming apparatus. In FIG. 5, a pair of opposed groove-shaped first guide means 103 are formed in a lower frame 101 of the main body B along an insertion direction (shown by the arrow C) for the process cartridge A so that, when the process cartridge A is mounted to and dismounted from the main body B, the guide portions 10 (FIGS. 3 and 4) of the process cartridge A are slid in the first guide means 103. Each guide means 103 includes a guide portion 103*a* along which the corresponding guide portion 10 is slid, and a recessed portion 103*b*, contiguous to the guide portion 103*a*, for to rotatably holding the process cartridge A.

Further, a pair of opposed groove-shaped second guide means 104 are formed on an inner surface of the lower frame 101 so that, when the process cartridge A is mounted to and dismounted from the main body B, the first positioning means 9 (FIGS. 3 and 4) of the process cartridge A are slid in the second guide means 104.

Each guide means 104 includes a guide portion 104*b* along which the corresponding first positioning means 9 is slid, and a positioning means 104*a* contiguous to the guide portion 104*b*. After the first positioning means 9 are slid along the guide portions 104*b*, the first positioning means 9 are engaged by the positioning means 104*a* to thereby position and secure the process cartridge A. Further, there are provided rotation regulating portions 105 capable of abutting against the second positioning means 11 of the process cartridge A to regulate the rotation of the process cartridge A, and an urging means 106, for urging the urged portion 12, constituting the upper surface of the process cartridge A.

When the process cartridge A is mounted to the main body B of the image forming apparatus, first of all, a lid 102 hinged to the lower frame 101 of the main body B is opened, and then, the process cartridge A is inserted into the main body B while inserting the first positioning means 9 into the second guide means 104 and the guide portions 10 into the first guide means 103.

When the process cartridge A is inserted in this way, the guide portions 10 are slid along the guide portions 103*a* toward the recessed portions 103*b*. When the guide portions 10 reach the recessed portions 103*b*, since the process cartridge A is urged by the urging means 106, the process cartridge is lowered, to lower the third frame 8. As a result, the first positioning means 9 of the process cartridge A abut against the guide portions 104*b* of the second guide means 104 of the main body B.

Figure 6:
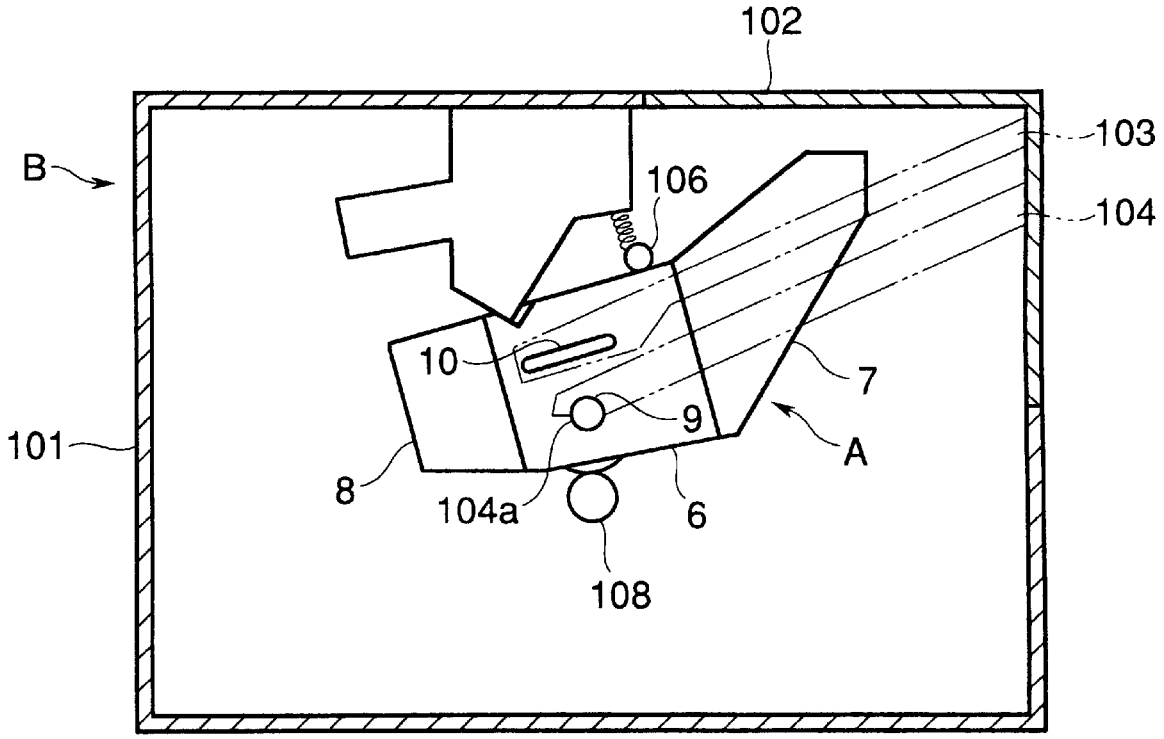
FIG. 6 is an explanatory view showing the process cartridge mounted in the image forming apparatus.

As the process cartridge A is further advanced, the first positioning means 9 are engaged by the positioning means 104*a* of the second guide means 104. In this case, since the rear ends of the guide portions 10 are spaced apart from the guide portions 103*a* of the first guide means 103, the process cartridge A is rotated around the first positioning means 9 in a clockwise direction by the urging means 106. As a result, the second positioning means 11 abut against the rotation regulating portions 105 of the main body B to thereby determine the angular position of the process cartridge A around the positioning means 9. After the process cartridge A is mounted in this way, the lid 102 is closed as shown in FIG. 6.

Figure 7:
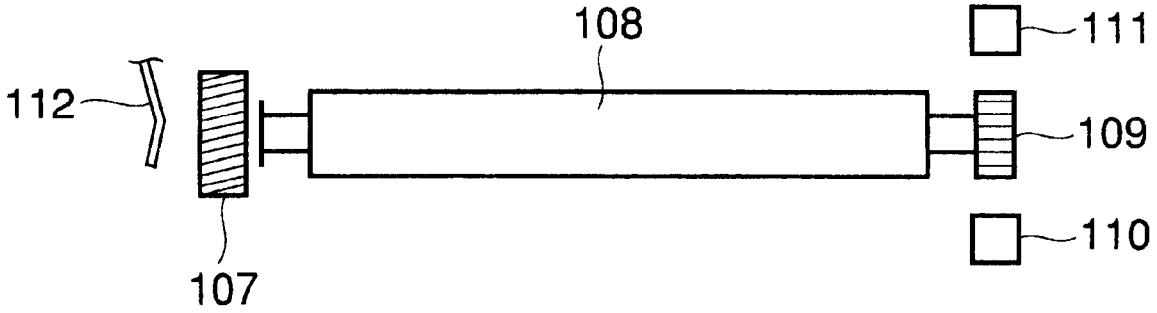
FIG. 7 is a plan view of a bottom of the apparatus to receive the process cartridge.

When the process cartridge A is mounted to the main body B in this way, as shown in FIG. 7, the first gear 16, formed on one end of the photosensitive drum 1, and the second gear 17, formed on the other end of the photosensitive drum 1, are engaged by third and fourth gears 107, 109 provided on the bottom of the main body for receiving the process cartridge A. The third gear 107 serves to rotatingly drive the first gear 16 of the photosensitive drum 1, and the fourth gear 109 is provided on one end of the transfer roller 108 and is driven by the second gear 17 of the photosensitive drum 1.

The bottom of the main body B is provided with a first contact 110 to contact the first electrical contact 13 of the process cartridge A, a second contact 111 contact with the second electrical contact 14, and a third contact 112 positioned in the vicinity of the third gear 17 at a higher position than the third gear 107 (in a direction perpendicular to the plane of FIG. 7) in correspondence to the third electrical contact 15 of the process cartridge A. The first and second contacts 110, 111 are biased toward a front side of the plane of FIG. 7 so that, when the first and second electrical contacts 13, 14 of the process cartridge A contact with the first and second contacts 110 and 111, the first and second contacts 110 and 111 are slightly depressed toward a rear side of the plane of FIG. 7 to thereby provide proper contacting force. The third contact 112 is formed from a spring made of conductive material, such as metal, to generate an elastic force when depressed toward the left in FIG. 7, so that, when the process cartridge A is mounted to the main body, the third contact contacts the third electrical contact 15 of the process cartridge A with proper pressure to thereby provide the electrical connection between the third contacts 112 and 115.

Figure 8:
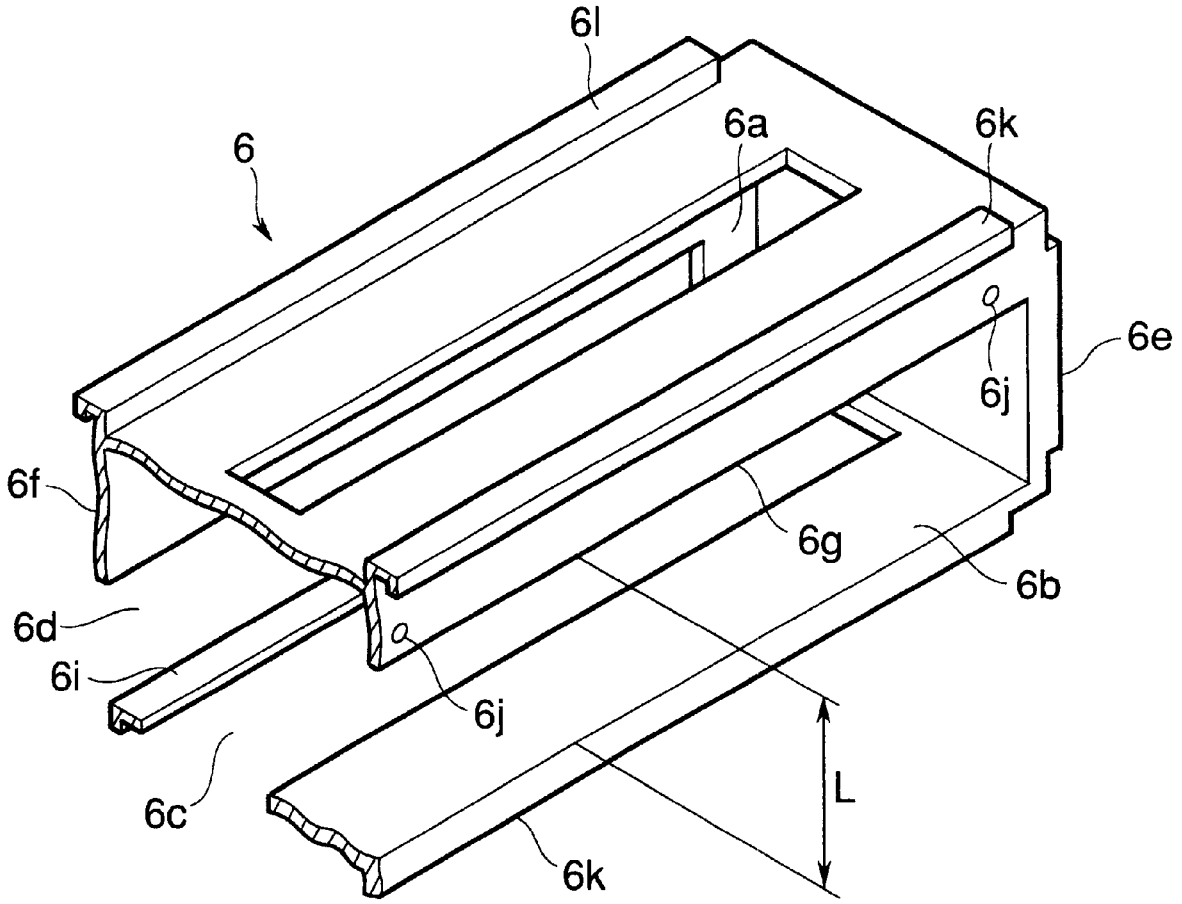
FIG. 8 is a partial perspective view of a first frame of the process cartridge.

Next, the construction of the first frame 6 of the process cartridge A will be fully explained with reference to FIG. 8 which is a partial perspective view of the first frame. As shown in FIG. 8, the first frame 6 is formed as a box-shaped configuration by two opposed side portions 6*a* (only one of which is shown in FIG. 8) and first to connection portions 6*f*, 6*g*, 6*h* and 6*i* inter-connecting the two side portions 6*a* and extending in a longitudinal direction.

The first opening 6*a* of the first frame 6 is formed in the connection portion 6*h*, the second opening 6*b* is formed in the connection portion 6*g*, the third opening 6*c* is formed in the connection portion 6*i*, and the fourth opening 6*d* is formed in the connection portion 6*f*. Among the first to fourth openings 6*a* to 6*d*, for example, only the second opening 6*b* has an opening dimension L greater than the diameter of the photosensitive drum 1, so that an opening permitting the insertion of the photosensitive drum 1 and the like into the first frame is limited to only one. By setting only the second opening 6*b* to be greater and the other openings 6*a*, 6*c* and 6*d* to be smaller in this way, the widths and rigidity of the connection portions 6*f*, 6*g*, 6*h* and 6*i* can be increased, so that the rigidity of the first frame 6 is increased.

By increasing the rigidity of the first frame 6 in this way, the positioning accuracies of the photosensitive drum 1 and the process means, acting as the photosensitive drum 1, such as the developing sleeve 2, charge roller 5 and cleaning blade 4 (the positioning accuracies thereof are important), can be improved, and the positional accuracy between the photosensitive drum 1 and the transfer roller is maintained, thus obtaining a good image.

Further, the deformation of the first frame 6 (when the driving force of the main body B of the image forming apparatus acts on the process cartridge A) can be minimized, and thus, for example, the deviation (twist) between the generatrix of the photosensitive drum 1 and the generatrix of the developing sleeve 2 can be minimized. As a result, a distance between the surface of the photosensitive drum 1 and the surface of the developing sleeve 2 can be stabilized along the entire longitudinal direction thereof, so that problems with the image, such as density unevenness, can be eliminated.

The second connection portion 6*g* also acts as a fixed portion to which the layer thickness regulating blade 3 is attached. In the illustrated embodiment, the connection portion 6*g* is provided at both longitudinal end portions thereof with attachment holes 6*j*, through which the layer thickness regulating blade 3 is secured to the connection portion 6*g* by screws. The first connection portion 6*f* also acts as a fixed portion to which the cleaning blade 4 is attached. Thus, the connection portion 6*f* is provided at both longitudinal end portions with attachment holes (not shown) through which the cleaning blade 4 is secured to the connection portion 6*f* by screws. The second and first connection portions 6*g* and 6*f* have locking portions 6*k* and 6*l* to which the second frame 7 and the third frame 8 are attached, respectively.

Figure 9:
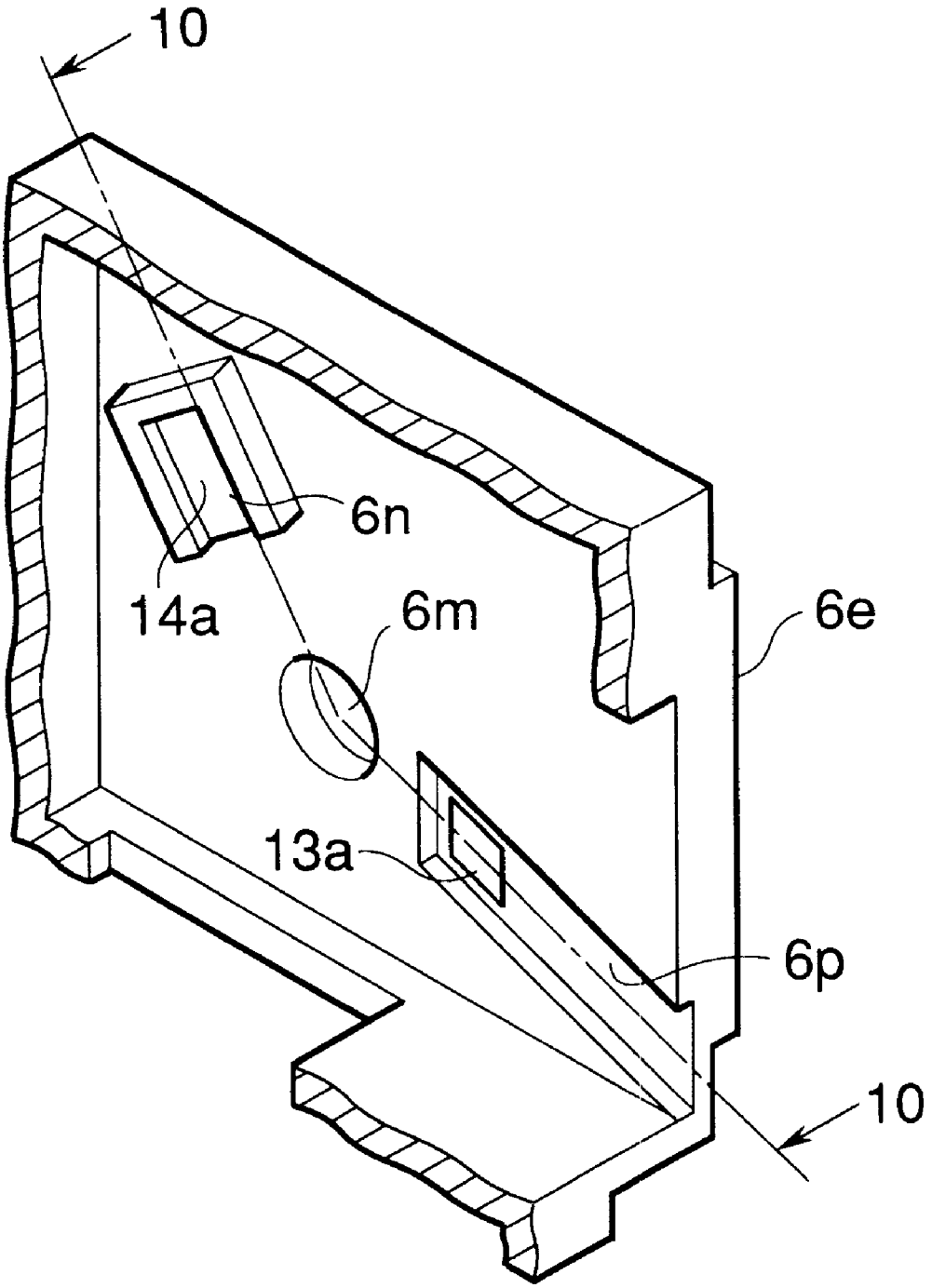
FIG. 9 is a partial perspective view showing an inner wall of a side of the first frame.

On the other hand, as shown in FIG. 9, in order to rotatably support the photosensitive drum 1, each side portion 6*e* of the first frame 6 is provided at its inner surface with an axial hole 6*m* for receiving a shaft of the photosensitive drum, a charge roller guide groove 6*n* for guiding the charge roller 5, and a developing sleeve guide groove 6*p* for guiding the developing sleeve 2. A part 14*a* of the second electrical contact 14 for contacting the second contact 111 of the main body B extends into a part of the charge roller guide groove 6*n* and a part 13*a* of the first contact 13 for contacting the first contact 110 of the main body B extends into a part of the developing sleeve guide groove 6*p*.

Figure 10:
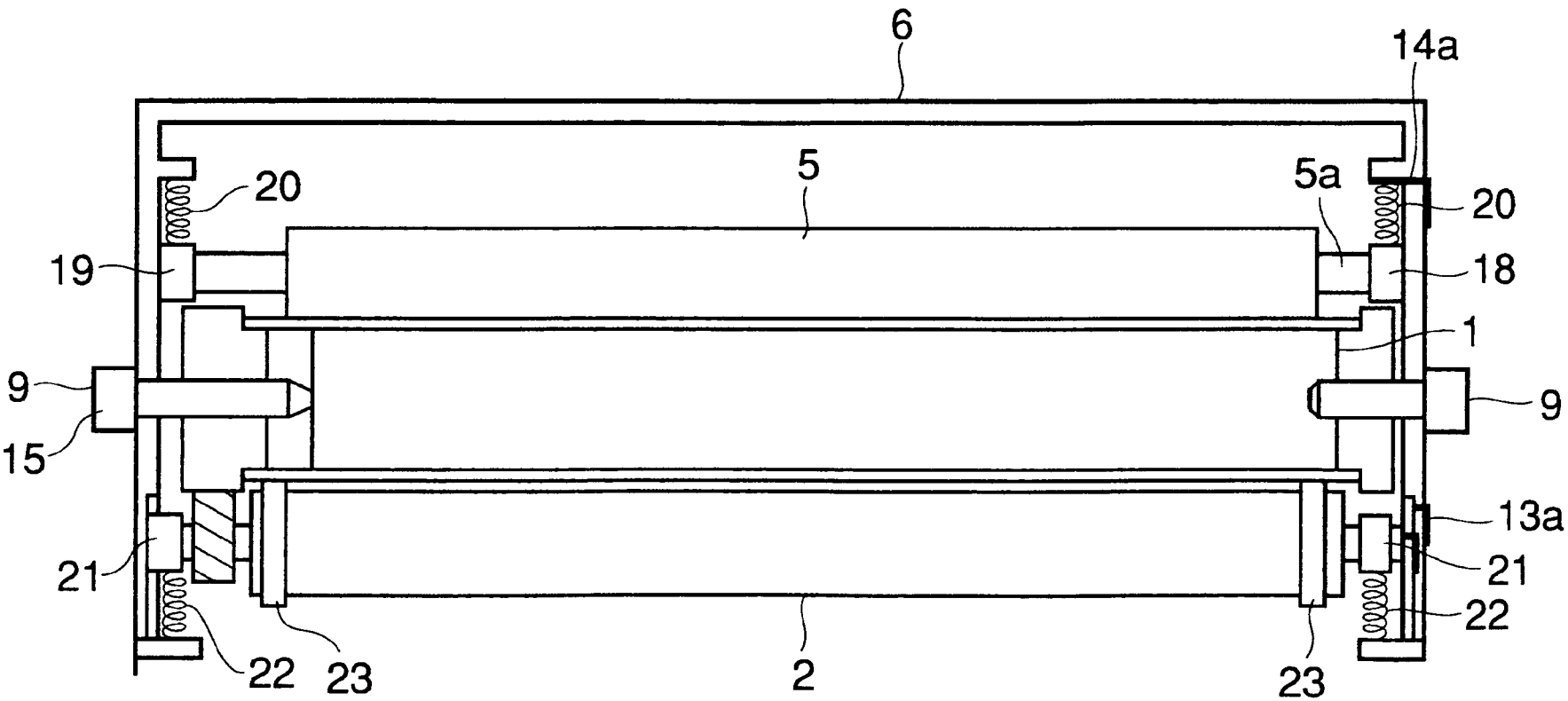
FIG. 10 is a view showing a charge roller and a photosensitive drum incorporated into the first frame.

FIG. 10 shows a condition that the charge roller 5, the photosensitive drum 1 and the developing sleeve 2 are incorporated into the first frame 6 so constructed. Incidentally, FIG. 10 is a sectional view taken along the line 10—10 in FIG. 9. The charge roller 5 is rotatably attached to the first frame 6 by holding metallic shafts 5*a* on both ends of the charge roller in bearings 18, 19. The bearings 18, 19 can be slid along the charge roller guide grooves 6*n* (FIG. 9), and the bearing 18 is formed from conductive material such as conductive plastic. Biasing means, such as metallic coil springs 20, are connected to the bearings 18, 19, and one of the coil springs 20 contacts the part 14*a* of the second contact 14. Hence, the charge roller 5 is electrically connected to the second contact 14 and the charge roller 5 is urged against the photosensitive drum 1 to be rotated by the rotation of the photosensitive drum 1.

On the other hand, both ends of the developing sleeve 2 are received in bearings 21 formed from plastic material having good sliding ability, and the bearings 21 can be slid along the developing sleeve guide groove 6*p* (FIG. 9). Biasing means, such as coil springs 22, are connected to the bearings 21 so that the developing sleeve 2 is biased toward the photosensitive drum 1 by the coil springs 22. As a result, the outer peripheral surfaces of cylindrical spacers 23 provided on both end portions of the developing sleeve 2 abut against the surface of the photosensitive drum 1 to thereby position the developing sleeve 2 with respect to the photosensitive drum 1 with a predetermined gap therebetween.

In order to assemble the process cartridge having the above-mentioned construction, first of all, the first and second electrical contacts 13, 14 are attached to the first frame 6 (refer to FIG. 4). Then, the coil springs 20 are attached to the bearings 18, 19 for supporting the charge roller 5, and the bearings are received in the charge roller guide grooves 6*n* (FIG. 9) formed in the inner surfaces of the side portions 6*e* of the first frame 6. Thereafter, the charge roller 5 is attached to the bearings 18, 19 received in the charge roller guide grooves 6*n*.

Then, the photosensitive drum 1 is inserted into the first frame 6 through the second openings 6*b*, and the first positioning means 9 on both longitudinal ends of the frame 6 are inserted. Then, a unit obtained by attaching the spacers 23, bearings 21, and coil springs 22 to the developing sleeve 2 is incorporated into the first frame through the second opening 6*b* while sliding the bearings 21 along the developing sleeve guide groove 6*p* (FIG. 9). After the charge roller 5, the photosensitive drum 1 and the developing sleeve 2 are incorporated in this way, the layer thickness regulating blade 3 is attached to the first frame 6 and the cleaning blade 4 is attached.

Then, the second frame 7 and the third frame 8 are attached to the first frame 6. When the second frame 7 is attached, after the developer container 26 is housed in the developer containing portion 7A, the locking portion 6*k* (FIG. 8) of the first frame 6 is locked to one side of the second frame 7 so that the second opening 6*b* is aligned with the developer supply opening 7*a* of the second frame 7, and then, the other sides of the second frames are connected to the first frame by U-shaped elastic members 24 (FIGS. 2 to 4).

As a result, seal members 25 (FIG. 2) are compressed to prevent the developer from leaking through the seal members. Incidentally, the connecting direction is perpendicular to the axis of the photosensitive drum 1. When the third frame 8 is attached, after the waste developer container 28 is housed in the waste developer containing portion 8A, the locking portion 61 (FIG. 8) of the first frame 6 is locked to one side of the third frame 8 so that the third opening 6*c* is aligned with the waste developer collecting opening 8*a* of the third frame 8, and then, the other sides of the third frames are connected to the first frame by the U-shaped elastic members 24. Incidentally, the connecting direction is perpendicular to the axis of the photosensitive drum 1.

As mentioned above, by manufacturing the first frame 6 of the process cartridge A independently from the second and third frames 7, 8 which do not require the same accuracy and rigidity as the first frame 6, the second and third frames 7, 8 can be made of cheaper material and the structures of the second and third frames can be simplified. Further, since the second and third frames 7, 8 can easily be mounted to and dismounted from the first frame 6, for example, when the developer is used up or when the waste developer container is filled with the waste developer, after the elastic members 24 are removed, by disassembling the second frame 7 or the third frame 8 in the direction perpendicular to the axis of the photosensitive drum 1, new developer can easily be replenished in the second frame 7 or the waste developer can easily be removed from the third frame 8. Thus, not only the replenishment of developer can easily be performed at a manufacturing factory but also any expert can easily replenish new developer at user's site.

When the process cartridge is used for a long time while replenishing developer repeatedly, if a service life of any part in the first frame 6 is expired or if the usage limit of any part is reached, by replacing the first frame 6 and the parts incorporated into the first frame 6 as a unit by a new unit, the process cartridge A can be re-used. Since such replacement is easy, not only the old unit (the first frame 6 and the parts incorporated into the first frame) can easily be replaced by a new unit at a manufacturing factory, but also, any expert can easily replace the old unit by a new unit at user's site.

Figure 11:
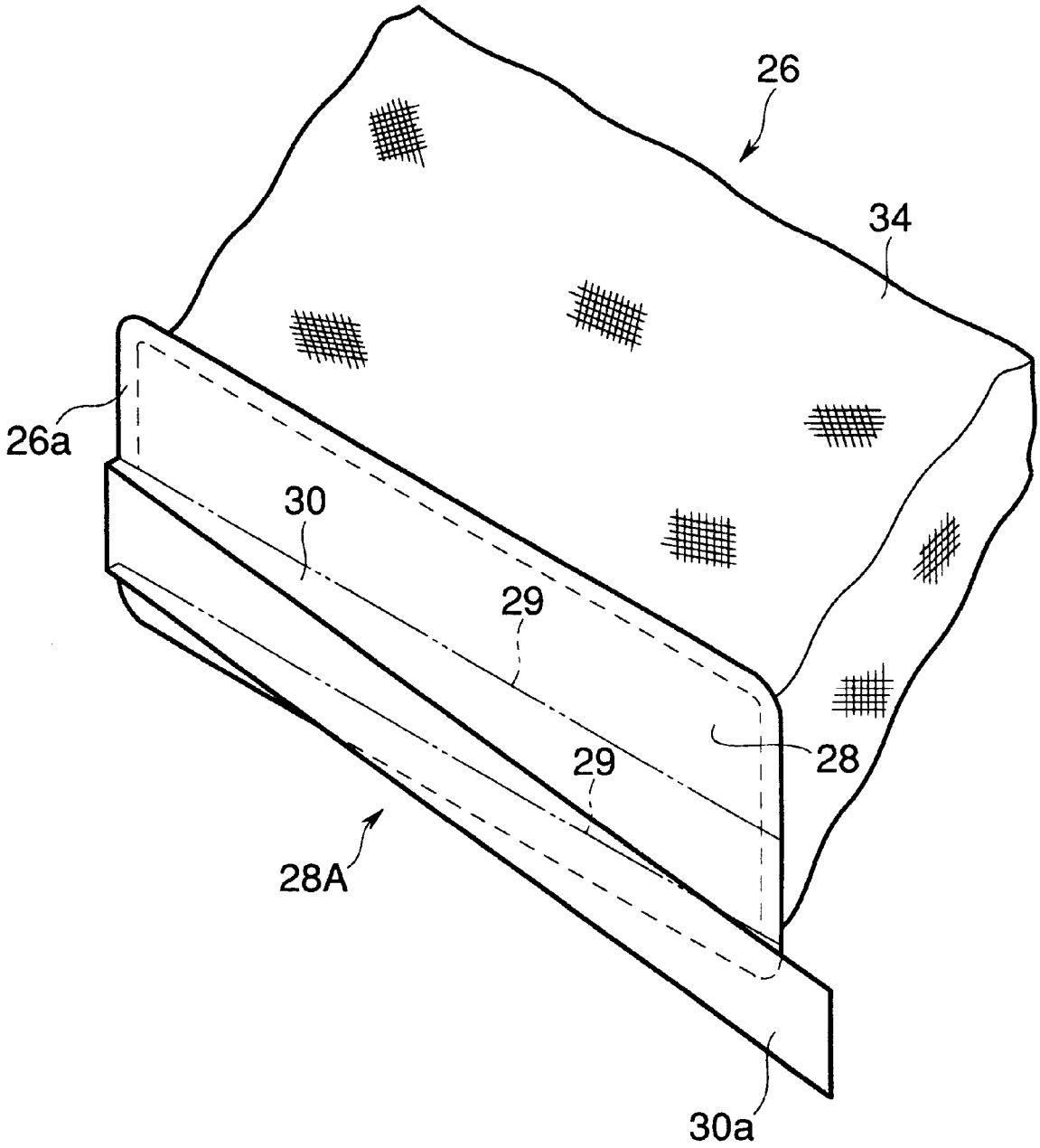
FIG. 11 is a perspective view of a developer container of the process cartridge.

Next, the developer container 26 will be described. FIG. 11 is a perspective view of the developer container 26. The developer container 26 includes a bag 34 made of permeable sheet, and a tear tape unit (sealing means) 28A joined to the bag 34.

The permeable sheet from which the bag 34 is formed may be a synthetic resin porous sheet having fine pores smaller than the particle diameter of the developer or a laminated sheet comprised of such a porous sheet and non-woven fabric. By forming the bag 34 from the permeable sheet, an increase in the internal pressure in the bag due to a change in temperature can be prevented to thereby prevent the swelling of the bag 34.

In the illustrated embodiment, the permeable sheet is manufactured by laminating the porous resin sheet with non-woven fabric, and the diameters of pores are selected to prevent the passage of the developer but permit the passage of air. For example, when the average particle diameter of the developer (toner) is 7 $\mu$m, the average diameter of the pores in the sheet is selected to be about 2 $\mu$m. More specifically, "Bresslon" (registered trade mark manufactured by Nittoh Denko Co., Ltd. (Japan)) may be used as the porous resin sheet. Since the diameter of pores in such porous resin sheet can be appropriately adjusted by a manufacturing condition, the diameter of pores can be selected in accordance with the toner particle diameter.

The sealing means serves to seal an opening of the bag 34 made of the permeable sheet after the developer is loaded in the bag 34 through the opening, and the opening may be sealed, for example, by closing inner peripheral surface of the opening by using a double-face adhesive tape, by closing the opening by using hot melt adhesive, or by closing the opening by providing a protruded rail member of a fastener on one side of the inner surface of the opening and a recessed rail member of the fastener on the other side of the inner surface and by closing the fastener (i.e., engaging the protruded rail member with the recessed rail member). Alternatively, a discrete member having opening means may be attached to the opening of the bag.

The sealing means has an opening means which may be, for example, a thread previously adhered to an inner surface of the bag and having one end extending out of the bag. When the bag is opened, the portion of the bag 34 to which the thread is adhered is torn by pulling the thread. Alternatively, the opening means may be a member for generating a force for opening the sealed portion of the double-face adhesive tape or the fastener on the double-face adhesive tape or the fastener. When a discrete member is used as the sealing means, the opening means may be a tear member for tearing the discrete member. Incidentally, the inlet of the bag through which the developer is loaded in the developer container 26 may be the same as or different from the outlet of the bag through which the developer is discharged.

The tear tape unit 28A as the sealing means in the illustrated embodiment includes a cover film 28 for covering or closing the opening of the bag 34, and a tear tape 28 connected to the cover film 29 via tear lines 29 to cover a part of the opening. After the tear tape 30 is fixed to a part of a flange 26*a*, the tear tape is folded back.

When the bag is opened, by pulling the free end portion 30*a*, the tear tape 30 is peeled from the flange 26*a* and the cover film 28 is torn along the tear lines 29 so that an opening (defined between the tear lines) is formed in the cover film 28 in a condition where the opening of the bag is still pealed, thus permitting the supply of the developer.

On the other hand, in order to load the developer in the developer container 26 shown in FIG. 11, before the tear tape unit 28A is secured to the bag 34, the developer is loaded in the bag through the opening of the bag, and, thereafter, the opening of the bag is sealed by the tear tape unit. Alternatively, a developer loading hole (not shown) is previously formed in the bag 34, and, after the tear tape unit 28A is secured to the bag 34, the developer is loaded through the developer loading hole and then the developer loading hole is closed by an appropriate sheet member (not shown) to seal the bag.

The bag 34 has a configuration conforming to the inner surfaces of the second frame 7 (see FIG. 2). To obtain such a configuration of the bag 34, the permeable sheet is partially cut, then the sheet is bent to form the bag, and then the cut portions of the sheet are joined by a hot melt.

Figure 12:
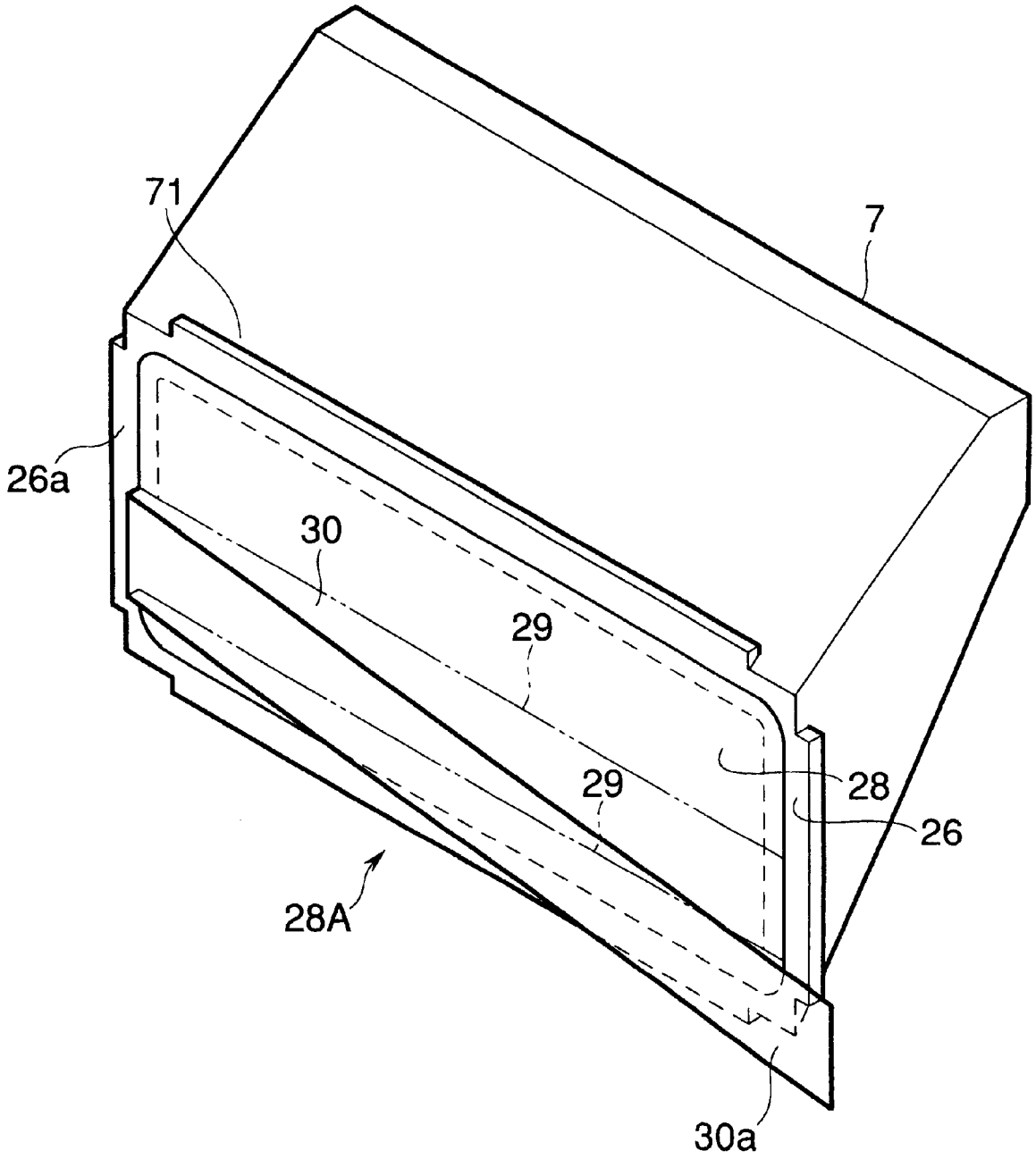
FIG. 12 is a perspective view showing the developer container housed in a second frame.

FIG. 12 shows the condition that the developer container 26 is housed in the second frame 7. In this case, the entire bag 34 is contained within the second frame 7 and the peripheral flange 26*a* of the developer container 26 overlaps with the peripheral edge of the opening of the second frame 7. In this condition, by connecting the second frame to the first frame 6, the flange 26*a* of the developer container is pinched and positioned between the first frame 6 and the second frame 7.

The peripheral flange 26*a* may be formed by bending the peripheral portion of the opening of the bag 34 to conform to the peripheral edge of the opening of the second frame, or by bending the peripheral portion of the above-mentioned discrete member as the sealing member to conform to the peripheral edge of the opening of the second frame. Alternatively, a member conforming to the peripheral edge of the opening of the second frame may be attached to the developer container.

Figure 13:
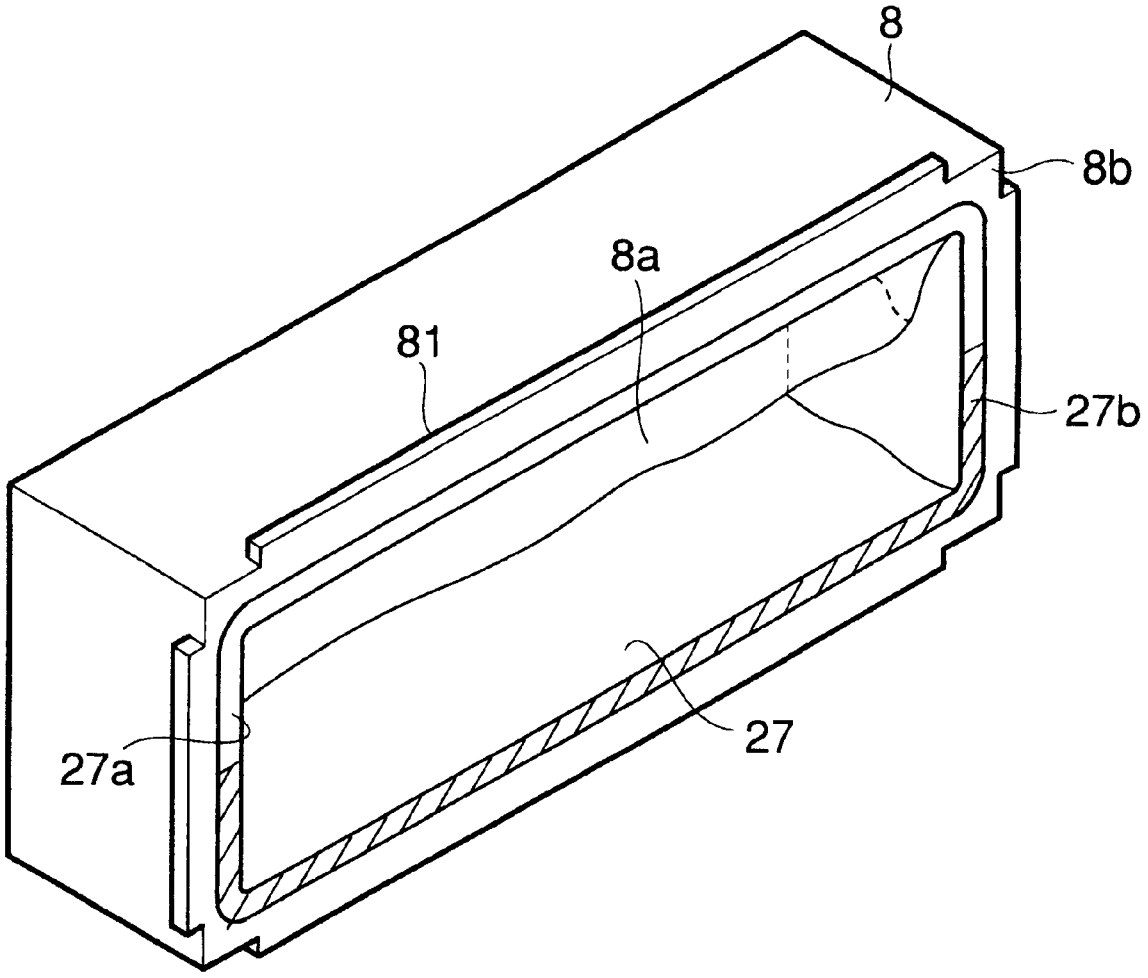
FIG. 13 is a perspective view showing a waste developer container of the process cartridge housed in a third frame.

FIG. 13 is a perspective view showing a condition that the waste developer container 27 is housed in the third frame 8. The waste developer container 27 is positioned so that a flange 27*a* thereof is overlapped with a peripheral flange 8*b* of a waste developer collecting opening 8*a* (of the third frame) opposed to the photosensitive drum 1. Incidentally, a U-shaped double-face adhesive tape 27*b* with a base sheet is adhered to a lower half portion of the flange 27*a*.

When the container 27 is filled with the waste developer, the base sheet on the double-face adhesive tape 27*b* is peeled from the adhesive tape, and the lower half portion of the flange 27*a* is folded back onto an upper half portion of the flange to adhere the half portions to each other by the double-face adhesive tape 27*b*, so that the waste developer within the container 27 is sealed. In this condition, the waste developer container 27 can be removed from the third frame 8. In FIG. 13, the third frame 8 has a locking portion 81 to be locked to the locking portion 61 of the first frame 6. As with the developer container 26, the waste developer container 27 is preferably formed from a permeable sheet.

As mentioned above, according to the illustrated embodiment, when the unused developer or the waste developer is preserved at a place out of the process cartridge A, there is less danger of smudging the surroundings of the process cartridge A and the operator's hands with developer when the developer is loaded into or removed from the process cartridge, since the developer is sealed within the container. The loading or removal of the developer can easily be effected by an expert at the user's site. Further, the user himself can load the new developer and remove the waste developer.

Next, a method for replenishing the developer in the process cartridge A will be explained. When the developer is replenished, first of all, the connection between the first and second frames 6 and 7 is released by removing the elastic members 24, then the second frame 7 is rotated relative to the first frame 6, and then the remaining developer is removed from the second frame 7. Thereafter, a new developer container 26 containing new developer is housed in the second frame 7, then the second frame 7 is rotated relative to the first frame 6 to close the frames, and then the frames 6, 7 are interconnected by the elastic members 24.

Figure 14:
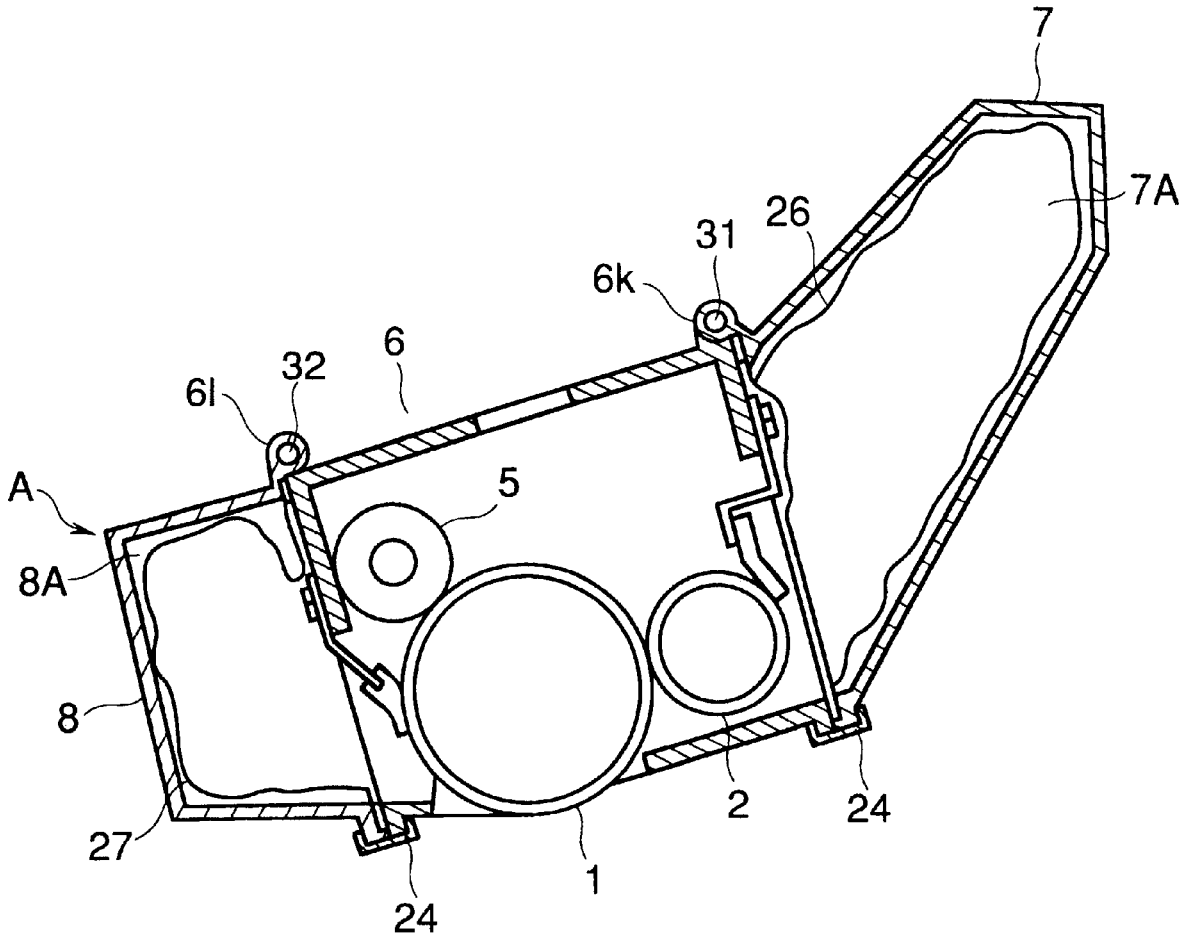
FIG. 14 is a sectional view of a process cartridge showing another example of the connection between the frames.
Figure 15:
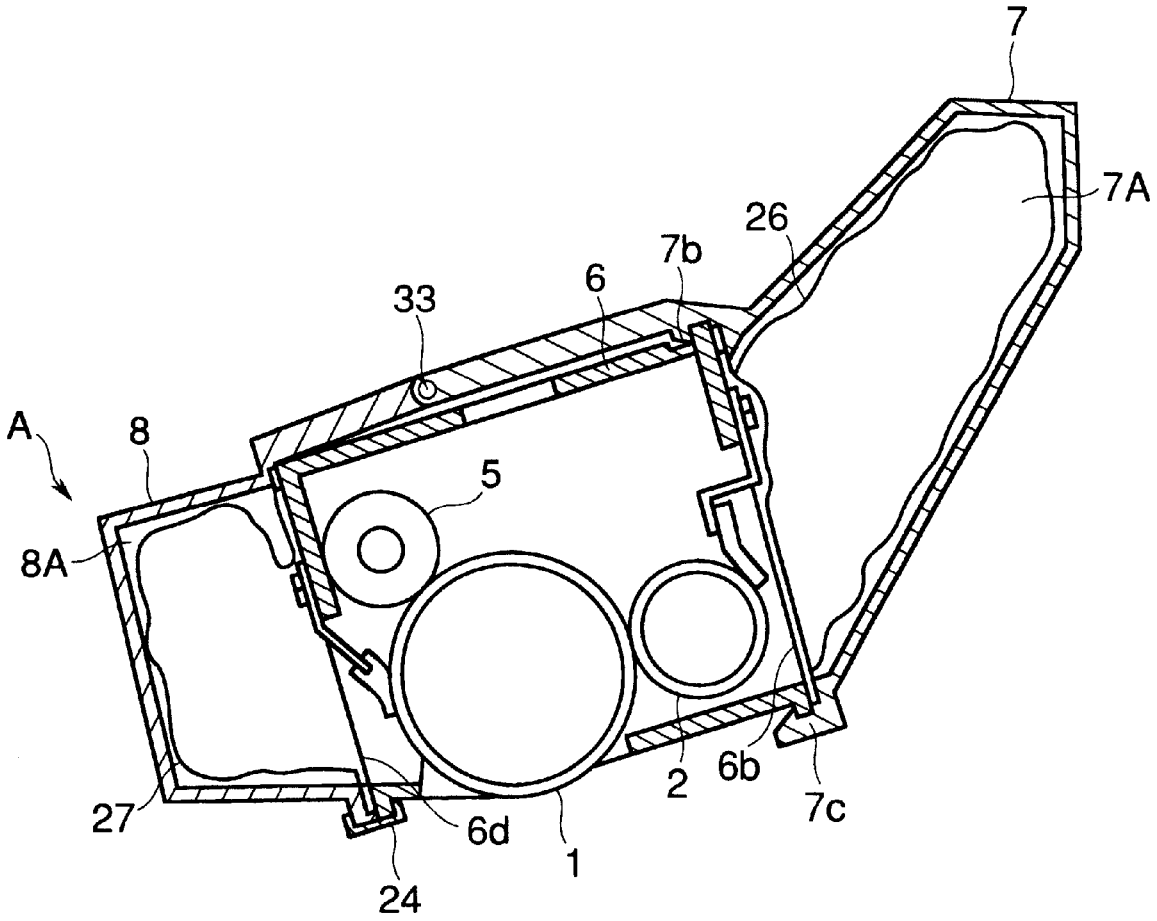
FIG. 15 is a sectional view of a process cartridge showing a further example of the connection between the frames.

FIGS. 14 and 15 are sectional views showing other examples of methods for interconnecting the frames.

In FIG. 14, the reference numeral 31 denotes rotary shaft for rotatably holding the second frame 7 with respect to the first frame 6, and 32 denotes a rotary shaft for rotatably holding the third frame 8 with respect to the first frame 6. Bearings (not shown) for holding these rotary shafts 31, 32 are provided on the first frame 6.

By rotatably attaching the second and third frames 7, 8 to the first frame 6 via the rotary shafts 31, 32 in this way, for example, when the new developer is replenished or when the waste developer is removed, the second frame 7 or the third frame 8 can be rotated with respect to the first frame merely by removing the elastic members 24 to thereby facilitate the replenishment of the new developer and the removal of the waste developer.

In an example shown in FIG. 15, the second and third frames 7 and 8 are rotatably interconnected via a connection rotary shaft 33, and the second frame 7 is locked to the first frame 6 by locking pawls 7*b* and 7*c*. The connection rotary shaft 33 and the second and third frames 7, 8 constitute a connection unit in which the second and third frames 7, 8 can be pivoted between a first position where the openings 7*a* and 8*a* (FIG. 2) of the second and third frames are aligned with the second opening 6*b* and the fourth opening 6*d* of the first frame 6, and a second position where the opening 7*a* and/or the opening 8*a* are disengaged from corresponding openings 6*b* and/or 6*d* even when one of the second and third frames 7, 8 is positioned at the first position. When the connection unit is in the second position, the first frame can be dismounted from the connection unit.

In the process cartridge A having the above construction, when the new developer is replenished and the waste developer is removed, first of all, the connection between the first frame 6 and the third frame 8 (in the first position) is released by removing the elastic members 24, and then the third frame 8 is brought to the second position. After the waste developer container 27 housed in the third frame 8 is sealed or closed, the first frame 6 is disengaged from the third frame 8.

Then, by releasing the locking pawls 7*b* and 7*c*, the first frame 6 is removed from the second frame 7. After the empty developer container 26 is removed from the second frame 7, a new developer container 26 is housed in the second frame 7, and the second frame 7 and the first frame 6 are interconnected again by the locking pawls 7*b* and 7*c*. Thereafter, a new waste developer container 27 is housed in the third frame 8, and the third frame 8 and the first frame 6 are interconnected again by the elastic members 24. While an example that the second frame 7 and the first frame 6 are interconnected by the locking pawls 7*b* and 7*c* was explained, the second frame 7 and the first frame 6 may be interconnected by using screws or by using the elastic members.

In the illustrated embodiment, since the second and third frames 7, 8 are rotatably interconnected as the connection unit to which the first frame can detachably be mounted, not only the replenishment and removal of the developer can be facilitated, but also the replacement of the first frame and associated parts (as the unit) can be facilitated.

The connecting method for interconnecting the frames may utilize the pawls provided on one of the frames and the pawl receiving portions provided on the other frame (refer to FIG. 15), the elastic members for interconnecting the first and second frames (refer to FIG. 2), or screws for interconnecting the frames, so long as the interconnected first and second frames 6, 7 can be returned to the disconnected condition. Further, it is not needed that the first and second frames 6 and 7 are not completely separated from each other after the disconnection, and thus, for example, the first and second frames 6 and 7 may be pivotally interconnected, so long as the developer container 26 can be housed within the second frame 7.

As mentioned above, according to the illustrated embodiment, since the developer container 26 is formed from the permeable sheet, the change in internal pressure in the container due to the change in temperature can be minimized. Thus, since the developer container 26 can be prevented from swelling during the transportation, it can be effectively packed into a relatively small box for transportation. Further, since the strength of the sealing means for sealing the developer within the developer container may be relatively small, a cheaper sealing means can be used.

Further, since there is no swelling of the developer container 26, the developer container 26 can be formed to have substantially the same volume as that of the second frame 7.

In this case, the developer container 26 can easily be housed in the second frame 7. Hence, new developer can be supplied to the process cartridge A by an expert or the user himself.

In the illustrated embodiment, since the developer container 26 is positioned within the process cartridge A via the annular flange 26*a*, the developer supply opening of the developer container 26 is prevented from shifting within the process cartridge A, so that the developer can be surely supplied to the developing sleeve (developer bearing member) 2. Further, since the annular flange 26*a* closely contacts the peripheral edge of the opening of the second frame 7, the developer discharged from the developer container 26 does not smudge the inner surface of the second frame 7 and the outer surface of the developer container 26. Thus, the developer container 26 can be replaced without contamination.

Since the internal pressure in the developer container is not increased, when the developer container 26 is opened, the developer is not suddenly discharged from the container, and the leakage of developer from the process cartridge due to sudden discharge can also be prevented.

In the illustrated embodiment, the waste developer container 27 is also formed from the bag, at the same time when the new developer is replenished, so that the waste developer container 27 can be sealed and then be removed together with the waste developer from the third frame 8, and a new waste developer container 27 can be loaded. When the waste developer container 27 is also formed from a permeable sheet, since the change in the internal pressure thereof can be suppressed, the waste developer can be prevented from leaking by sealing the waste developer container by a simple sealing means. Thus, the handling of the waste developer is facilitated.

Figure 16:
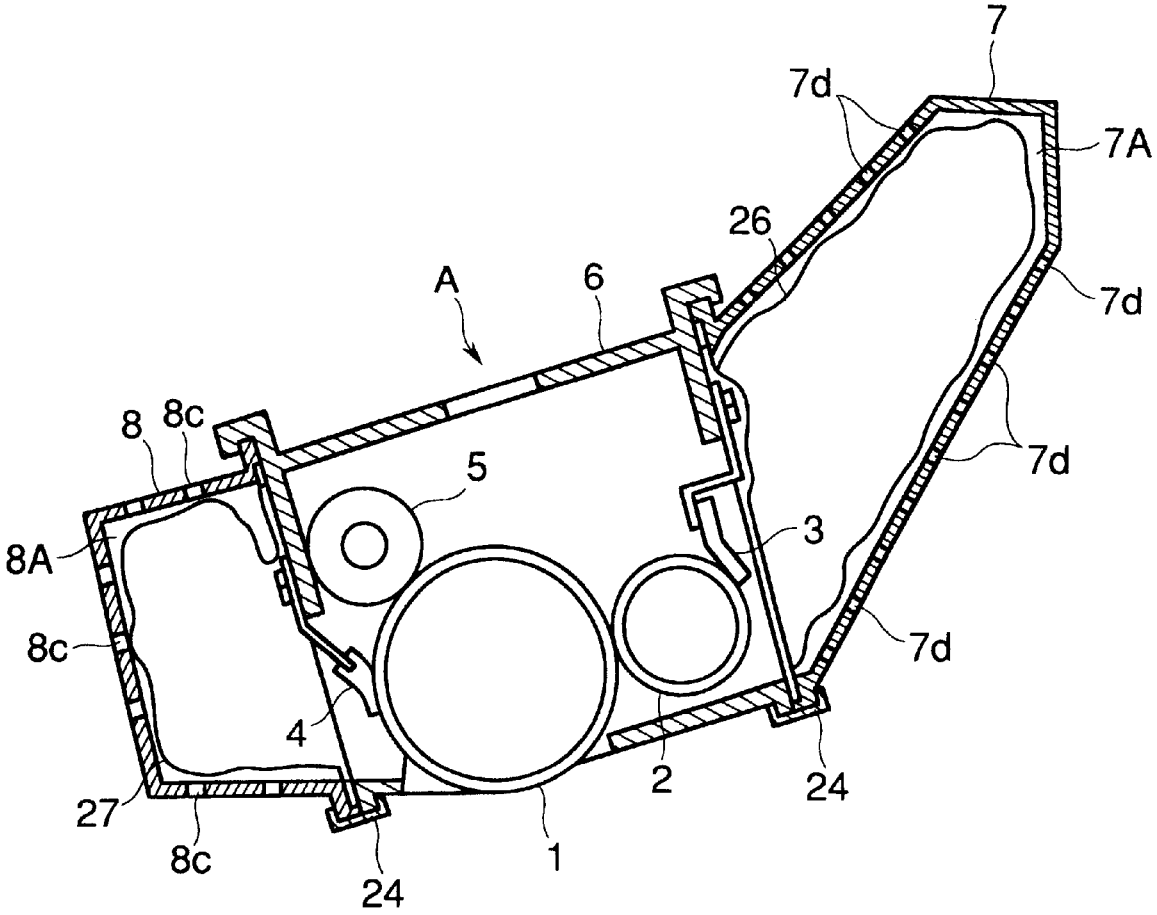
FIG. 16 is a sectional view of a process cartridge according to a second embodiment of the present invention.

FIG. 16 is a sectional view of a process cartridge A according to a second embodiment of the present invention. In FIG. 16, only second and third frames 7, 8 differ from those in the first embodiment. Since the other constructions are the same as those in the first embodiment, an explanation thereof will be omitted.

In this second embodiment, as shown in FIG. 16, a second frame 7 is provided with a plurality of small holes 7*d*. The small holes 7*d* pass through the wall of the second frame 7, and these holes are circular holes each having a diameter (for example, about 0.3 mm or more (for example, about 3 mm)) considerably greater than the particle diameter of the developer (toner).

Similarly, a third frame 8 is provided with a plurality of small holes 8*c* similar to the small holes 7*d*. The small holes 7*d*, 8*c* are formed not only in the walls of the frames 7, 8 shown in FIG. 16, but also in the walls of the frames not shown in FIG. 16.

As shown in the illustrated embodiment, since the small holes 7*d*, 8*c* are formed in the second and third frames 7, 8, when the developer container 26 and the waste developer container 27 are housed in or removed from the second and third frames 7 and 8, respectively, the replacement of the containers 26, 27 can be facilitated since the air flows through the small holes 7*d*, 8*c*.

Figure 17:
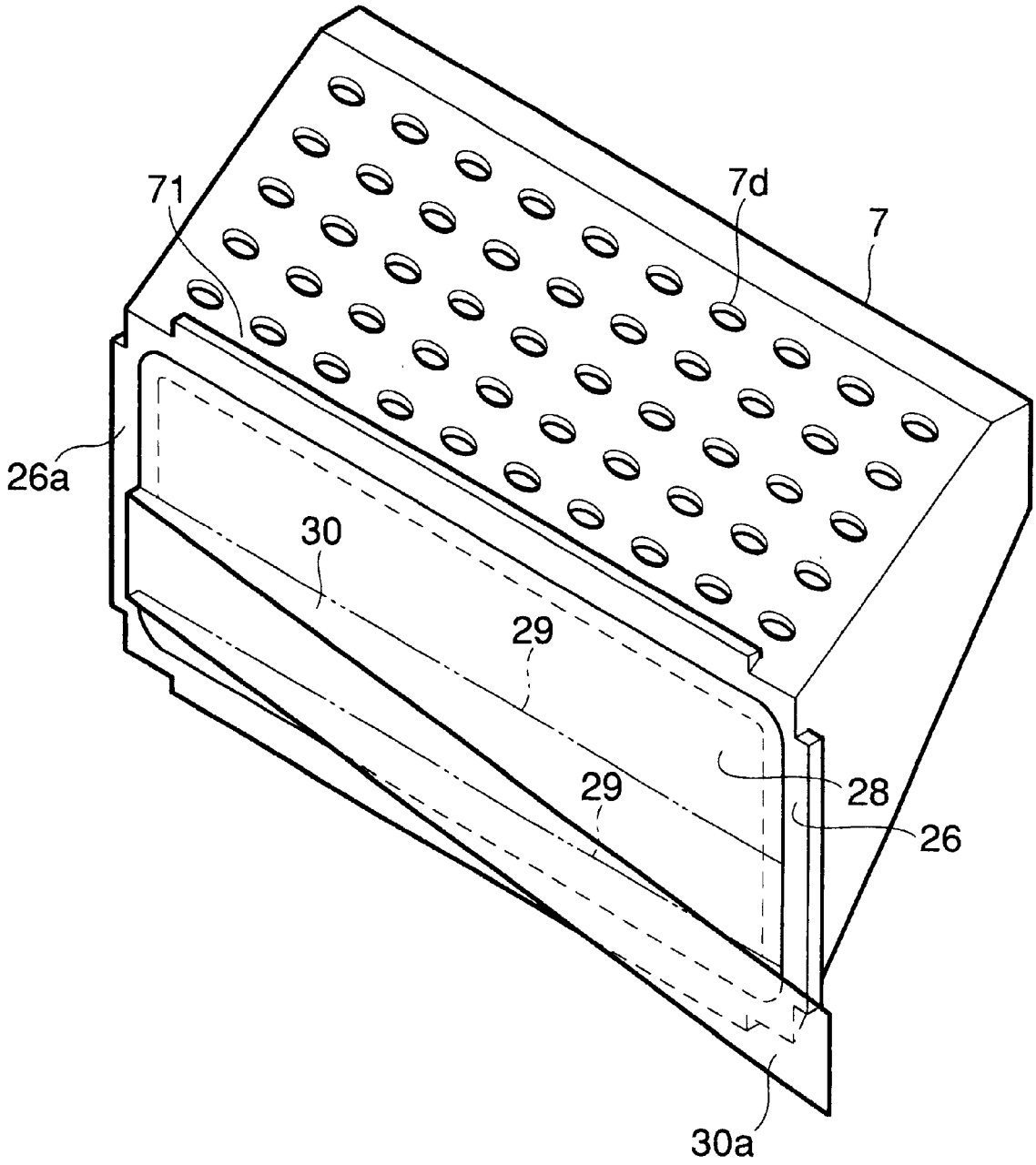
FIG. 17 is a perspective view showing a developer container housed in a second frame of the process cartridge having small holes formed in an upper surface.

In FIG. 16, while an example that the small holes 7*d*, 8*c* are formed in both upper and lower surfaces of the second and third frames 7, 8 was explained, for example, such small holes may be formed in only the upper surfaces of the second and third frames. In this case, the increase in temperature in the frames due to heat generated during the operation of the image forming apparatus can also be prevented, and thus, the heat is prevented from negatively influencing the developer. Incidentally, FIG. 17 shows the condition that the developer container 26 is housed in the second frame 7 having the small holes 7*d* formed in only the upper surface.

As mentioned above, according to the above-mentioned embodiments, since the developer container is formed from the permeable sheet to suppress a change in internal pressure due to a change in temperature, the developer container can be prevented from swelling during the transportation. Since there is no swelling of the container, the developer container can easily be housed in the second frame. Further, when the developer container is opened, the developer is not suddenly discharged from the container, and the leakage of developer from the process cartridge due to sudden discharge can also be prevented.

Further, according to the above-mentioned embodiments, the second frame can temporarily be detached from the first frame to replenish the new developer by detachably mounting the second frame to the first frame when the developer is used up. Thus, the first frame can be re-used. Further, by detachably mounting the third frame to the first frame, when the waste developer container is filled with the waste developer, the third frame can temporarily be detached from the first frame to remove the waste developer. Thus, the first frame can be re-used.

By utilizing the re-usable frame, the photosensitive drum and the like supported in the re-usable frame can also be re-used. As mentioned above, according to the present invention, the developer can be replenished.

What is claimed is:

1. A process cartridge detachably mountable to a main body of an electrophotographic image forming apparatus, comprising:

a first frame for supporting an electrophotographic photosensitive drum and a developer bearing member for developing a latent image formed on said electrophotographic photosensitive drum with developer; and a second frame having a developer containing portion containing the developer for developing the latent image formed on said electrophotographic photosensitive drum, and being detachably mountable to said first frame;

wherein a mounting/dismounting direction of said second frame with respect to said first frame is substantially perpendicular to the axial direction of said electrophotographic photosensitive drum, wherein said first frame has a plurality of openings therein, one of which permits developer to passes from said developer containing portion to said developer bearing member, wherein only the opening permitting developer to pass has an opening dimension greater than the diameter of said electrophotographic photosensitive drum.

2. A process cartridge according to claim 1, further comprising a developer container, wherein the developer is contained and sealed in said developer container having opening means, and said developer container is replaceably housed in the developer containing portion of said second frame.

3. A process cartridge according to claim 2, wherein at least a portion of said developer container is formed from a permeable sheet for preventing the passage of the developer out of said developer container and permitting the passage of air into and out of said developer container.

4. A process cartridge according to claim 2 or 3, wherein said second frame has an opening at a position opposed to said developer bearing member, and said opening means is provided at a position corresponding to an opening of the developer container housed in said second frame.

5. A process cartridge according to claim 4, further comprising sealing for covering the developer container opening and attached to the peripheral edge of a flange of said developer container.

6. A process cartridge according to claim 2 or 3, wherein said second frame has a plurality of small holes therein extending from inside to outside of said second frame.

7. A process cartridge according to claim 1 or 3, wherein said first frame supports cleaning means for removing residual developer remaining on said electrophotographic photosensitive drum after transferring a toner image from said electrophotographic photosensitive drum to transfer material, and further detachably supports a third frame having a waste developer containing portion for containing waste developer removed by the cleaning means.

8. A process cartridge according to claim 7, further comprising a waste developer container for containing the waste developer, wherein said waste developer container is replaceably housed in the waste developer containing portion of the third frame.

9. A process cartridge according to claim 8, wherein said waste developer container includes sealing means for sealing the waste developer in said waste developer container and permitting the removal of said waste developer container from said third frame.

10. A process cartridge according to claim 9, wherein at least a portion of said waste developer container is formed from a permeable sheet preventing the passage of the developer out of said waste developer container and permitting the passage of air into and out of said waste developer container.

11. A process cartridge according to claim 10, wherein said waste developer container has a flange at a position corresponding to a peripheral portion of an opening of said third frame opposed to said electrophotographic photosensitive drum, wherein said sealing means is attached to said flange and is positioned in said third frame.

12. A process cartridge according to claim 11, wherein said third frame has a plurality of small holes therein extending from inside to outside of said third frame.

13. A process cartridge detachably mountable to a main body of an electrophotographic image forming apparatus, comprising:

a first frame for supporting an electrophotographic photosensitive drum and a developer bearing member for developing a latent image formed on said electrophotographic photosensitive drum with developer; and a second frame having a developer containing portion containing the developer for developing the latent image formed on said electrophotographic photosensitive drum and detachably mountable to said first frame;

wherein said second frame is supported rotatably with respect to said first frame, wherein said first frame has a plurality of openings therein, one of which permits developer to passes from said developer containing portion to said developer bearing member, wherein only the opening permitting developer to pass has an opening dimension greater than the diameter of said electrophotographic photosensitive drum.

14. A process cartridge according to claim 13, further comprising a developer container, wherein the developer is contained and sealed in said developer container having opening means, and said developer container is replaceably housed in the developer containing portion of said second frame.

15. A process cartridge according to claim 14, wherein at least a portion of said developer container is formed from a permeable sheet for preventing passage of the developer out of said developer container and permitting passage of air into and out of said developer container.

16. A process cartridge according to claim 15, wherein said second frame has an opening at a position opposed to said developer bearing member, and said opening means is provided at a position corresponding to an opening of said developer container housed in said second frame.

17. A process cartridge according to claim 16, further comprising sealing means for covering the developer container opening attached to the peripheral edge of a flange of said developer container.

18. A process cartridge according to claim 17, wherein said second frame has a plurality of small holes therein extending from inside to outside of said second frame.

19. A process cartridge according to claim 13 or 18, wherein said first frame supports cleaning means for removing residual developer remaining on said electrophotographic photosensitive drum after transferring of a toner image from said electrophotographic photosensitive drum to transfer material, and further rotatably supports a third frame having a waste developer containing portion for containing waste developer removed by said cleaning means.

20. A process cartridge according to claim 19, further comprising a waste developer container for containing the waste developer, wherein said waste developer container is replaceably housed in the waste developer containing portion of the third frame.

21. A process cartridge according to claim 20, wherein the waste developer container includes sealing means for sealing the waste developer in said waste developer container and permitting the removal of said waste developer container from said third frame.

22. A process cartridge according to claim 20 or 21, wherein at least a portion of said waste developer container is formed from a permeably sheet preventing the passage of the developer out of said waste developer container and permitting the passage of air into and out of said waste developer container.

23. A process cartridge according to claim 22, wherein said waste developer container has a flange at a position corresponding to a peripheral portion of an opening of said third frame opposed to said electrophotographic photosensitive drum, wherein said sealing means is attached to said flange and is positioned in said third frame.

24. A process cartridge according to claim 23, wherein said third frame has a plurality of small holes therein extending from inside to outside of said third frame.

25. A process cartridge according to claim 1, wherein said first frame includes positioning means for positioning said process cartridge with respect to the main body of the image forming apparatus when the process cartridge is mounted to the main body of the image forming apparatus, a drum grounding contact for electrically connecting said electrophotographic photosensitive drum to the main body of the image forming apparatus when said process cartridge is mounted to the main body of the image forming apparatus, and a developing contact for supplying voltage from the main body of the image forming apparatus to said developer bearing member when the process cartridge is mounted to the main body of the image forming apparatus.

26. A process cartridge according to claim 25, wherein said first frame supports charge means for charging said electrophotographic photosensitive drum and includes a charging contact for supplying voltage from the main body of the image forming apparatus to said charging means when the process cartridge is mounted to the main body of the image forming apparatus.

27. A process cartridge according to one of claims 13 to 18, wherein said first frame includes positioning means for positioning said process cartridge with respect to the main body of the image forming apparatus when the process cartridge is mounted to the main body of the image forming apparatus, a drum grounding contact for electrically connecting said electrophotographic photosensitive drum to the main body of the image forming apparatus when the process cartridge is mounted to the main body of the image forming apparatus, and a developing contact for supplying voltage from the main body of the image forming apparatus to said developer bearing member when the process cartridge is mounted to the main body of the image forming apparatus.

28. A process cartridge according to claim 27, wherein said first frame supports charge means for charging said electrophotographic photosensitive drum and includes a charging contact for supplying voltage from the main body of the image forming apparatus to said charge means when the process cartridge is mounted to the main body of the image forming apparatus.

29. A process cartridge according to claim 13, wherein at least a portion of said developer container is formed from a permeable sheet for preventing the passage of the developer out of said developer container and permitting the passage of air into and out of said developer container.

30. A developer container for supplying a developer to a process cartridge removably mountable to a main body of an image forming apparatus, said process cartridge including a first frame or supporting an electrophotographic photosensitive drum and a developer bearing member for developing a latent image formed on the electrophotographic photosensitive drum with developer and having an opening for introducing the developer to the developer bearing member, a second frame for replaceably containing the developer container containing the developer for developing the latent image formed on the electrophotographic photosensitive drum, said second frame having an opening for supplying the developer to the developer bearing member supported by said first frame, and connection means for interconnecting said first and second frames so that the opening of said first frame is opposed to the opening of said second frame and they can be spaced apart by releasing said connection means, wherein said first frame has a plurality of openings therein, one of which permits developer to passes from said developer containing portion to said developer bearing member, wherein only the opening permitting developer to pass has an opening dimension greater than the diameter of said electrophotographic photosensitive drum, said developer container comprising:

a developer containing portion for containing the developer, and a flange provided at a position corresponding to a peripheral edge of the opening of said second frame.

31. A developer container according to claim 30, wherein at least a portion of the developer container is formed from a permeable sheet preventing passage of the developer out of said developer container and permitting passage of air into and out of said developer container.

32. A waste developer container for containing waste developer removed from an electrophotographic photosensitive drum of a process cartridge removably mountable to a main body of an image forming apparatus, said process cartridge including a first frame for supporting an electrophotographic photosensitive drum and cleaning means for removing the waste developer on the electrophotographic photosensitive drum and having an opening for discharging the waste developer, a second frame for replaceably containing a waste developer container for containing the waste developer removed by said cleaning means and having an opening for receiving the waste developer, and connection means for interconnecting said first and second frames so that the opening of said first frame is opposed to the opening of said second frame and they can be spaced apart by releasing said connection means, said waste developer container comprising:

a developer containing portion for containing the developer;

a flange provided at a position corresponding to a peripheral edge of the opening of said second frame; and sealing means for sealing the waste developer in the waste developer container when the waste developer container is removed from said second frame, wherein said sealing means comprises U-shaped double-sided adhesive tape with a base sheet adhered to a lower half portion of said flange, wherein said base sheet is peelable from said two-sided adhesive tape, wherein a lower half portion of said flange is foldable onto an upper half portion of said flange to adhere the half portions to each other after said base sheet is peeled from the two-sided adhesive tape.

33. A waste developer container according to claim 32, wherein at least a portion of the waste developer container is formed from a permeable sheet preventing the passage of the developer out of said waste developer container and permitting the passage of air into and out of said waste developer container.

34. A method for assembling a process cartridge comprising the steps of:

preparing a first frame supporting an electrophotographic photosensitive drum and a developer bearing member for developing a latent image formed on the electrophotographic photosensitive drum with developer, wherein said first frame has a plurality of openings therein, one of which permits developer to passes from a developer containing portion to said developer bearing member, wherein only the opening permitting developer to pass has an opening dimension greater than the diameter of said electrophotographic photosensitive drum, wherein said preparing step further comprises the step of inserting said electrophotographic photosensitive member in said first frame by inserting said electrophotographic photosensitive member through said opening permitting developer to pass;

preparing a developer container sealingly containing the developer to be supplied to the developer bearing member and having opening means;

preparing a second frame capable of containing the developer container;

positioning the developer container in the second frame; and connecting the second frame containing the developer container therein to the first frame by releasable connection means from a direction substantially perpendicular to an axial direction of the electrophotographic photosensitive drum.

35. A method for assembling a process cartridge comprising the steps of:

preparing a first frame supporting an electrophotographic photosensitive drum, a developer bearing member for developing a latent image formed on the electrophotographic photosensitive drum with developer, and cleaning means for removing waste developer from the electrophotographic photosensitive drum, wherein said first frame has a plurality of openings therein, one of which permits developer to passes from a developer containing portion to said developer bearing member, wherein only the opening permitting developer to pass has an opening dimension greater than the diameter of said electrophotographic photosensitive drum, wherein said preparing step further comprises the step of inserting said electrophotographic photosensitive member in said first frame by inserting said electrophotographic photosensitive member through said opening permitting developer to pass;

preparing a developer container sealingly containing the developer to be supplied to the developer bearing member and having opening means;

preparing a second frame capable of containing the developing container;

preparing an empty waste developer container for containing the waste developer removed by the cleaning means;

preparing a third frame capable of containing the waste developer container;

positioning the developer container in the second frame;

connecting the second frame containing the developer container therein to the first frame by releasable connection means from a direction substantially perpendicular to an axial direction of the electrophotographic photosensitive drum;

positioning the waste developer container in the third frame; and connecting the third frame containing the waste developer container therein to the first frame by releasable connection means from a direction transverse to an axial direction of the electrophotographic photosensitive drum.

36. A method for re-filling developer in a process cartridge, comprising the steps of:

preparing the used process cartridge;

releasing a releasable connection means of the used process cartridge and rotating a first frame and a second frame of the process cartridge relative to each other, wherein said first frame supports an electrophotographic photosensitive drum and a developer bearing member for developing a latent image formed on the electrophotographic photosensitive drum with a developer, and said second frame has a developer containing portion containing the developer for developing the latent image formed on said electrophotographic photosensitive drum, wherein said first frame has a plurality of openings therein, one of which permits developer to passes from said developer containing portion to said developer bearing member, wherein only the opening permitting developer to pass has an opening dimension greater than the diameter of said electrophotographic photosensitive drum;

removing unused developer from the second frame; and rotating the first and second frames relative to each other to interconnect them by the releasable connection means.

37. A re-filling method according to claim 36, wherein the step of filling the new developer is a step of positioning the developer container sealingly containing the developer in the second frame.

38. The method according to claim 36, wherein said releasable connection means comprises a substantially U-shaped elastic member releasably connecting first and second frames.

39. A one-piece support frame to be used for a process cartridge to integrally support an electrophotographic photosensitive drum, a developer bearing member, and charge means, comprising:

a drum supporting portion for supporting the electrophotographic photosensitive drum;

a developer bearing member supporting portion for supporting the developer bearing member;

charge means supporting portion for supporting the charge means;

a first opening for exposing the electrophotographic photosensitive drum;

a second opening for supplying a developer to said developer bearing member; and a third opening for transferring a toner image from the electrophotographic photosensitive drum onto a recording medium;

wherein an attachment portion for attaching a second frame containing the developer to be supplied to said developer bearing member is provided around the second opening, wherein said second opening has an opening diameter greater than the diameter of said electrophotographic photosensitive drum, and said first and third openings do not have an opening diameter greater than the diameter of said electrophotographic photosensitive drum.

40. A one-piece support frame according to claim 39, further comprising support means for supporting cleaning means for removing waste developer from the electrophotographic photosensitive drum, and a fourth opening for discharging the waste developer removed by the cleaning means out of said one-piece support frame, wherein an attachment portion for attaching a third frame containing the waste developer is provided around said fourth opening.

41. A one-piece support frame according to claim 39 or 40, further comprising positioning means for positioning the process cartridge at a predetermined position of a main body of an image forming apparatus, and contact attaching portions for attaching a drum grounding contact, a charging contact, and a developing contact which electrically connects the main body of the image forming apparatus and the process cartridge.

42. A method for incorporating charge means, an electrophotographic photosensitive drum, and a developer bearing member into said one-piece support frame according to claim 37, comprising the steps of:

preparing the charge means, the electrophotographic photosensitive drum, the developer bearing member, and a layer thickness regulating member for regulating the layer thickness of the developer on the developer bearing member;

attaching the charge means to the one-piece support frame;

inserting the electrophotographic photosensitive drum through the second opening of the one-piece support frame and rotatably supporting the electrophotographic photosensitive drum by a positioning member;

inserting the developer bearing member through the second opening of the one-piece support frame attaching the developer bearing member; and attaching the layer thickness regulating member to the one-piece support frame.

* * * * *

UNITED STATES PATENT AND TRADEMARK OFFICE

CERTIFICATE OF CORRECTION

PATENT NO. : 6,009,289

DATED : December 28, 1999

INVENTOR(S) : Kazumi SEKINE et al.

It is certified that error appears in the above-identified patent and that said Letters Patent is hereby corrected as shown below:

ON THE COVER PAGE:

AT [56], References Cited, FOREIGN PATENT DOCUMENTS:

"02257146" should read --2-257146--.

COLUMN 1:

Line 46, "apparatus" should read --apparatus,--.
Line 49, "thus" should read --thus,--.

COLUMN 2:

Line 5, "cartridge" should read --cartridge,--.

UNITED STATES PATENT AND TRADEMARK OFFICE

CERTIFICATE OF CORRECTION

PATENT NO. : 6,009,289

DATED : December 28, 1999

INVENTOR(S) : Kazumi SEKINE et al.

It is certified that error appears in the above-identified patent and that said Letters Patent is hereby corrected as shown below:

COLUMN 3:

Line 37, "in" should read --on--.

COLUMN 4:

Line 14, "onto" should be deleted.
Line 50, "serves" should read --serve--.

COLUMN 5:

Line 31, "pair" should read --pairs--.

COLUMN 6:

Line 51, "contact with" should read --to contact--.
Line 59, "with" should be deleted.

UNITED STATES PATENT AND TRADEMARK OFFICE

CERTIFICATE OF CORRECTION

PATENT NO. : 6,009,289

DATED : December 28, 1999

INVENTOR(S) : Kazumi SEKINE et al.

It is certified that error appears in the above-identified patent and that said Letters Patent is hereby corrected as shown below:

COLUMN 7:

Line 49, "is" should be deleted.

COLUMN 9:

Line 53, "temperature" should read --temperature,--.

Signed and Sealed this

Twenty-third Day of January, 2001

*Attest:*

Q. TODD DICKINSON

*Attesting Officer*

*Commissioner of Patents and Trademarks*